US012385365B2

(12) United States Patent
Donald et al.

(10) Patent No.: US 12,385,365 B2
(45) Date of Patent: Aug. 12, 2025

(54) APPARATUS, SYSTEMS AND METHODS FOR OIL AND GAS OPERATIONS

(71) Applicant: Enpro Subsea Limited, Aberdeen (GB)

(72) Inventors: Ian Donald, Inverurie (GB); John Reid, Perthshire (GB); Craig McDonald, Aberdeen (GB); Michael McGhie, Aberdeen (GB)

(73) Assignee: Enpro Subsea Limited, Aberdeen (GB)

( * ) Notice: Subject to any disclaimer, the term of this patent is extended or adjusted under 35 U.S.C. 154(b) by 208 days.

(21) Appl. No.: 17/996,068

(22) PCT Filed: Apr. 14, 2021

(86) PCT No.: PCT/GB2021/050902
§ 371 (c)(1),
(2) Date: Oct. 12, 2022

(87) PCT Pub. No.: WO2021/209754
PCT Pub. Date: Oct. 21, 2021

(65) Prior Publication Data

US 2023/0184063 A1 Jun. 15, 2023

(30) Foreign Application Priority Data

Apr. 14, 2020 (GB) ..... 2005412
Nov. 20, 2020 (GB) ..... 2018308

(51) Int. Cl.
*E21B 33/076* (2006.01)
*E21B 43/013* (2006.01)
*E21B 43/017* (2006.01)

(52) U.S. Cl.
CPC ..... *E21B 43/013* (2013.01); *E21B 33/076* (2013.01); *E21B 43/0175* (2020.05)

(58) Field of Classification Search
CPC ..... E21B 43/013; E21B 33/038; E21B 43/01; E21B 43/0175; E21B 33/076
See application file for complete search history.

(56) References Cited

U.S. PATENT DOCUMENTS 5,437,302 A * 8/1995 Da Silva ..... F16L 55/46 15/104.062
6,213,215 B1 * 4/2001 Breivik ..... E21B 7/128 166/350
2020/0332628 A1 * 10/2020 de Araujo Bernardo ..... E21B 43/01

FOREIGN PATENT DOCUMENTS

EP 1383985 B1 12/2004
EP 3719249 A1 10/2020
(Continued)

*Primary Examiner* — Benjamin F Fiorello
(74) *Attorney, Agent, or Firm* — Holzer Patel Drennan

(57) ABSTRACT

The invention provides a subsea oil and gas production installation, methods of installing the installation and methods of use. The installation comprises a subsea production system comprising a first production pipeline and a second production pipeline, a first subsea manifold in fluid communication with the first production pipeline comprising a fluid access interface and a flowline connector, a removable module fluidly connected to the fluid access interface of the first subsea manifold and configured to receive production fluid from one or more subsea wells and a second subsea manifold in fluid communication with the second production pipeline. The first subsea manifold defines a first flow path between the fluid access interface and the first production pipeline and a second bypass flow path between the fluid access interface and the flowline connector. The first and the second subsea manifolds are fluidly coupled to one another by a connecting flowline which is connected at a first end to the flowline connector of the first subsea manifold. The removable module comprises a flow control means operable to selectively route the production fluid from one or more
(Continued)

subsea wells into the first production pipeline via the first flow path defined by the manifold, and/or into the second production pipeline via the second bypass flow path, the connecting flowline and the second subsea manifold.

20 Claims, 23 Drawing Sheets

(56) References Cited

FOREIGN PATENT DOCUMENTS

| | | | | | |
|---|---|---|---|---|---|
| WO | 2013121212 | A2 | | 8/2013 | |
| WO | 2016097717 | A2 | | 6/2016 | |
| WO | WO-2019008435 | A1 | * | 1/2019 | ..... E21B 43/017 |
| WO | 2020120964 | A1 | | 6/2020 | |
| WO | 2020157509 | A1 | | 8/2020 | |

* cited by examiner

APPARATUS, SYSTEMS AND METHODS FOR OIL AND GAS OPERATIONS

The present invention relates to apparatus, systems and methods for oil and gas operations, in particular to apparatus, systems and methods for hydrocarbon production, and/or for providing fluid control, and/or performing measurement and/or intervention in oil and gas production or injection systems. The invention has particular application to subsea oil and gas operations, and aspects of the invention relate specifically to apparatus, systems and methods for hydrocarbon production which may include fluid control, measurement and/or intervention in subsea oil and gas production and injection infrastructure.

BACKGROUND TO THE INVENTION

In the field of subsea engineering for the hydrocarbon production industry, subsea manifolds may be connected to one or more flowlines coming from or going to other flow infrastructure within the flow system.

One type of subsea manifold is a well gathering manifold. This can accommodate numerous subsea wells at once to receive production flow from one or more subsea wells and often also has additional functionality. An alternative type of subsea manifold is an in-line tee. An in-line tee is a piece of infrastructure which can be incorporated into a pipeline or a flowline to create a branched tie-in point for one or more additional pipelines or flowlines. For example, an in-line tee may provide a tie-in point to a main production flowline for a flowline carrying production fluids from a subsea well. The term "subsea manifold" may also be used more generally to refer to a subsea well gathering system.

During the development of subsea hydrocarbon fields, it is often the case that further tie-ins to the flow system infrastructure are required, for example as new hydrocarbon discoveries are made and additional wells are drilled. As such, one or more in-line tees may be provided on the flow system to accommodate future tie-in requirements. If an in-line tee tie-in point is not immediately required, the branched tie-in point may be provided with a flow cap to shut it off, such that the pipeline can function as normal until such time that the tie-in point is required. Providing in-line tees on the flow system to meet current and future well tie-in requirements will bring initial expenditure down, because in-line tees are generally less expensive than the typical well-gathering manifolds that can accommodate numerous wells at once. However, a number of benefits which are realised by the use of more traditional subsea infrastructure—such as typical well gathering manifolds—are not translated into a disjointed system utilising individual branched tie in points from in-line tees.

In addition, in-line tees are fully equipped with all of the equipment, instrumentation and valving needed to facilitate their intended use. Whatever the type of subsea manifold, if the internal equipment, instrumentation and/or valving within the manifold is to fail, the entire manifold must be recovered in order to repair or replace these parts. This typically requires large vessels, is expensive, disruptive and potentially damaging to the surrounding subsea infrastructure, and is disruptive to production operations.

WO2013/121212 describes an apparatus and system for accessing a flow system such as a subsea tree or a subsea manifold by providing a flow access apparatus which can be used at a variety of access points. The apparatus and methods of WO2013/121212 enable a range of fluid intervention operations, including fluid sampling, fluid diversion, fluid recovery, fluid injection, fluid circulation, fluid measurement and/or fluid metering.

WO2016/097717 also describes an apparatus and system for accessing a flow system. In particular, WO2016/097717 provides a multi-bore apparatus which facilitates fluid communication between one or more subsea process apparatus and the flow system in use.

SUMMARY OF THE INVENTION

There is generally a need for a method and apparatus which addresses one or more of the problems identified above.

It is amongst the aims and objects of the invention to provide a subsea distributed manifold system which mitigates drawbacks of prior art subsea manifolds and methods of use.

It is amongst the aims and objects of the invention to provide an improved subsea distributed manifold system.

An object of the invention is to provide a flexible system and method of use suitable for use with and/or retrofitting to industry standard or proprietary oil and gas system infrastructure.

According to a first aspect of the invention, there is provided a subsea oil and gas production installation, the installation comprising:

- a subsea production system comprising a first production pipeline and a second production pipeline;
- a first subsea manifold in fluid communication with the first production pipeline comprising
- a fluid access interface and a flowline connector;
- a removable module fluidly connected to the fluid access interface of the first subsea manifold and configured to receive production fluid from one or more subsea wells; and
- a second subsea manifold in fluid communication with the second production pipeline;
- wherein the first subsea manifold defines a first flow path between the fluid access interface and the first production pipeline and a second bypass flow path between the fluid access interface and the flowline connector;
- wherein the first and the second subsea manifolds are fluidly coupled to one another by a connecting flowline connected at a first end to the flowline connector of the first subsea manifold; and
- wherein the removable module comprises a flow control means operable to selectively route the production fluid from one or more subsea wells into the first production pipeline via the first flow path defined by the manifold, and/or into the second production pipeline via the second bypass flow path, the connecting flowline and the second subsea manifold.

The connecting flowline may be a jumper flowline. The connecting flowline may be connected at a second end to a flowline connector of the second subsea manifold. Alternatively, the connecting flowline may be connected at a second end to a second removable module fluidly connected to a fluid access interface of the second subsea manifold.

The removable module may be a flow access hub, which may be a simple flow access hub for connection of flow components, with no additional valves, controls, instrumentation, or metering functionality. Alternatively, or in addition, the removable module may be a functional module, which may comprise valves, controls, instrumentation, and/or metering functionality, and which may be configured to be connected to the manifold via a flow access hub. The flow control means operable to selectively route the production fluid from one or more subsea wells into the first production pipeline via the first flow path defined by the manifold, and/or into the second production pipeline via the second bypass flow path, the connecting flowline and the second subsea manifold may be provided in a flow access hub removable module and/or may be provides in a functional removable module.

The removable module (for example, a flow access hub) may be directly connected to the fluid access interface of the first subsea manifold. Alternatively, the removable module (for example, a functional module) may be connected to the fluid access interface of the first subsea manifold via a flow access hub.

The removable module (for example, a flow access hub and/or a functional module) may be configured to receive production fluid from one or more subsea trees directly. Alternatively, the removable module (for example, a functional module) may be configured to receive production fluid from one or more subsea trees via a flow access hub.

A flow access hub, which may be a flow access hub removeable module and/or a flow access hub for connecting a functional removable module to a manifold, may comprise a flowline inlet bore for connection to a flowline configured to carry fluid from a subsea well. The flowline inlet bore may comprise a flowline connector for a flowline configured to carry fluid from a subsea well. Alternatively, or in addition, the flowline inlet bore of the flow access hub may be integrally formed with a flowline configured to carry fluid from a subsea well. The flow access hub may therefore be a part of a flowline jumper system, and therefore may be within the jumper envelope. The flow access hub may therefore be a flow access hub that can be deployed with the jumper system and/or retrieved from a manifold and subsea flow system with the jumper system, without causing disruption to the manifold or the wider flow system.

The flow access hub may comprise a first interface (a manifold interface) connected to the fluid access interface of the first subsea manifold. The fluid access interface of the first subsea manifold may be a single bore interface and the first interface of the flow access hub may be a single bore interface. Alternatively, the fluid access interface of the first subsea manifold may be a dual bore interface and the first interface of the flow access hub may be a dual bore interface.

The flow access hub may comprise a second interface (a module interface) connected to an interface of a functional module, which may be a functional removable module. The functional module interface may be a dual bore interface and the second interface of the flow access hub may be a dual bore interface. Alternatively, the functional module interface may be a triple bore interface and the second interface of the flow access hub may be a dual bore interface.

The first interface (the manifold interface) of the flow access hub may have a lesser number of bores than the second interface (the module interface) of the flow access hub.

The flow access hub may define a first flow path between the flowline inlet bore and the second interface to fluidly connect a flowline configured to carry fluid from a subsea well to the functional module. The flow access hub may define a second flow path between the second interface and the first interface to fluidly connect the functional module to the first subsea manifold.

The second subsea manifold may comprise a flowline connector. A second end of the connecting flowline may be connected to the flowline connector. The connecting flowline may be a jumper flowline and the flowline connector may be a flowline connector for a jumper flowline.

The second subsea manifold may comprise a fluid access interface. The installation may comprise a removable module fluidly connected to the fluid access interface of the second subsea manifold. The removable module may be a flow access hub. Alternatively, or in addition the removable module may be a functional module which may be configured to be connected to the manifold via a flow access hub. The connecting flowline may be fluidly connected to the functional module. Alternatively, or in addition, the functional module may be configured to receive production fluid from one or more subsea wells. The functional module may be directly connected to a fluid access interface of the second subsea manifold. Alternatively, the functional module may be connected to a fluid access interface of the second subsea manifold via a flow access hub. The functional module may be configured to receive production fluid from the connecting flowline or from one or more subsea wells directly. Alternatively, the functional module may be configured to receive production fluid from the connecting flowline or from one or more subsea wells via a flow access hub. The flow access hub may therefore be a part of a flowline jumper system, and therefore may be within the jumper envelope. The flow access hub may therefore be a flow access hub that can be deployed with the jumper system and/or retrieved from a manifold and subsea flow system with the jumper system, without causing disruption to the manifold or the wider flow system.

The flow control means may be one or more valves and/or an arrangement of valves which may include flow control valves, isolation valves, check valves, ball valves, gate valves and/or a combination thereof. The one or more valves may be electrically actuated valves, manually actuated valves, hydraulically actuated valves, other types of valves or a combination thereof. The one or more valves may be operable to selectively allow or prevent flow of fluid through one or more flow paths defined by the removable module (i.e. the flow access hub and/or the functional module). The one or more valves may be operable by any suitable means, for example from the surface and/or from a subsea control module (SCM) and/or by an ROV and/or by a diver.

The functional module may comprise further components, including but not limited to flow control elements, flowlines, fluid access points, instrumentation (such as pressure and temperature sensors) and/or valves, pumps or other suitable flow boosting means, filters, flow measurement equipment or instruments, solid or phase separation equipment, and/or sampling equipment, which may be operable by any suitable means, for example from the surface and/or from a subsea control module (SCM) and/or by an ROV and/or by a diver. The installation may be configured to perform distributed water injection or boosted water injection operations. The installation may be configured to perform artificial lift operations, including gas lift operations for displacing fluids which may otherwise impede production flow or production restarts.

Controls for the flow control means and/or the further flow components may optionally be integrated into the functional modules, the first and/or second manifolds, the production jumper flowlines, connecting jumper flowlines or their respective connectors.

According to a second aspect of the invention, there is provided a subsea oil and gas production installation, the installation comprising:

a subsea production system comprising a first production pipeline and a second production pipeline;

a first subsea manifold configured to receive production fluid from one or more subsea wells and in fluid communication with the first production pipeline; and a second subsea manifold in fluid communication with the second production pipeline; wherein the first and the second subsea manifolds are fluidly coupled to one another by a connecting flowline; and wherein the installation is operable to selectively route production fluid into the first production pipeline via the first subsea manifold and/or into the second production pipeline via the first subsea manifold, the connecting flowline and the second subsea manifold.

The first subsea manifold and/or the second subsea manifold may be (but are not limited to being) a subsea manifold from the group comprising: a subsea collection manifold system, a subsea well gathering manifold, a subsea in-line tee (ILT), a subsea Pipe Line End Manifold (PLEM), a subsea Pipe Line End Termination (PLET) and a subsea Flow Line End Termination (FLET). Preferably, the first subsea manifold and/or the second subsea manifold are an ILT, a PLET and/or a combination of the two.

The first subsea manifold may be integrated into the first production pipeline and may comprise a flow bore which is continuous with the first production pipeline. The first subsea manifold may be in communication with the first production pipeline via an inlet connector and an outlet connector of the first subsea manifold, which may be configured to effectively integrate the first subsea manifold into the first production pipeline.

The second subsea manifold may be integrated into the second production pipeline and may comprise a flow bore which is continuous with the second production pipeline. The second subsea manifold may be in communication with the second production pipeline via an inlet connector and an outlet connector of the second subsea manifold, which may be configured to effectively integrate the second subsea manifold into the second production pipeline.

The connecting flowline may be a jumper flowline and may be a flexible jumper flowline or a rigid jumper flowline. Combinations of flexible and rigid jumper flowlines may be used within the system. The connecting flowline may be connected to the first and/or second subsea manifolds directly. The connecting flowline may be connected to an external flowline connector, such as a jumper flowline connector, of the first and/or second subsea manifolds. Alternatively, or in addition, one or both ends of the connecting flowline may be coupled to the first and or second subsea manifolds via an intermediate structure.

The first subsea manifold may be operable to route the production fluid received from one or more subsea wells into the first production pipeline or the second production pipeline via the connecting flowline and the second subsea manifold.

Either or both of the first and second subsea manifolds may comprise at least one fluid access point which may be configured to receive (i.e. be connected to) one or more removable modules. The one or more removable modules may comprise one or more flow access hubs. Alternatively, or in addition, the one or more removable modules may be one or more functional modules which may be configured to be connected to the manifold via one or more flow access hubs. The at least one fluid access point may be a single bore access point. Alternatively, or in addition, the at least one access point may be a dual bore and/or a multi-bore access point. The at least one removable module may be a single bore, dual bore and/or multi bore module.

The first subsea manifold may be configured to receive the production fluid from the one or more subsea wells via the one or more removable modules connected to the first subsea manifold. The one or more removable modules connected to the first subsea manifold may be configured to receive the production fluid from the one or more subsea wells, route the production fluid into the first subsea manifold and selectively route the production fluid into the first and/or the second production pipelines via the first subsea manifold. The one or more removable modules may comprise at least one valve which may be operable to selectively route production fluid into the into the first and/or the second production pipelines.

The second subsea manifold may be configured to receive the production fluid from the one or more subsea wells coupled to the first subsea manifold via the one or more removable modules connected to the second subsea manifold. The connecting flowline may be fluidly connected to the one or more removable modules connected to the second subsea manifold. A first end of the connecting flowline may be coupled to an external flowline connector of the first subsea manifold and a second end of the connecting flowline may be coupled to an external flowline connector of the one or more removable modules connected to the second subsea manifold. The one or more removable modules connected to the second subsea manifold may be configured to: receive the production fluid from the one or more subsea wells via the one or more removable modules connected to the first subsea manifold, the first subsea manifold and the connecting flowline and route the production fluid into the second subsea manifold and into the second production pipeline via the second subsea manifold. The one or more removable modules may comprise at least one valve which may be operable to permit flow of the production fluid into the into the second subsea manifold and consequently the second production pipeline.

Like the first subsea manifold, the second subsea manifold may also be configured to receive production fluid from one or more subsea wells. The second subsea manifold may be configured to receive the production fluid from the one or more subsea wells coupled to it via the one or more removable modules connected to the second subsea manifold. The one or more removable modules connected to the second subsea manifold may be configured to receive the production fluid from the one or more subsea wells, route the production fluid into the second subsea manifold and selectively route the production fluid into the first and/or the second production pipelines via the second subsea manifold. The one or more removable modules may comprise at least one valve which may be operable to selectively route production fluid into the into the first and/or the second production pipelines.

The first production pipeline and the second production pipeline may operate at the same and/or different working pressures. The installation may be configured to route production fluid into the first production pipeline and/or the second production pipeline depending upon the pressure of the well from which the production fluid originates.

Embodiments of the second aspect of the invention may include one or more features of the first aspect of the invention or its embodiments, or vice versa.

According to a third aspect of the invention, there is provided a subsea oil and gas production installation, the installation comprising:

a subsea production system comprising a first production pipeline and a second production pipeline;

at first subsea manifold configured to receive production fluid from one or more subsea wells and in fluid communication with the first production pipeline; and a second subsea manifold configured to receive production fluid from one or more subsea wells and in fluid communication with the second production pipeline;

wherein the first and the second subsea manifolds are fluidly coupled to one another.

The first subsea manifold and/or the second subsea manifold may be (but is not limited to being) a subsea manifold from the group comprising: a subsea collection manifold system, a subsea well gathering manifold, a subsea in-line tee (ILT), a subsea Pipe Line End Manifold (PLEM), a subsea Pipe Line End Termination (PLET) and a subsea Flow Line End Termination (FLET). Preferably, the first subsea manifold and/or the second subsea manifold are an ILT, a PLET and/or a combination of the two.

The first subsea manifold may be operable to route the production fluid received from one or more subsea wells into the first production pipeline or the second production pipeline via the second subsea manifold.

The second subsea manifold may be operable to route production fluid received from one or more subsea wells into the second production pipeline, or the first production pipeline via the first subsea manifold, or both.

The first and second subsea manifolds may comprise at least one fluid access point which may be configured to receive one or more removable modules. The at least one fluid access point may be a single bore access point. Alternatively, or in addition, the at least one access point may be a dual bore and/or a multi-bore access point. The at least one removable module may be a single bore, dual bore and/or multi bore module.

The one or more removable modules may comprise one or more flow access hubs. Alternatively, or in addition, the one or more removable modules may comprise one or more functional modules which may be configured to be connected to the manifold via one or more flow access hubs. The one or more removable modules may be configured to receive the production fluid from the one or more subsea wells, route the production fluid into the first and second subsea manifolds, respectively, and selectively route the production fluid into the first and/or the second production pipeline. The one or more removable module may comprise valves which are operable to selectively route production fluid into the into the first and/or the second production pipeline, via the first and/or second subsea manifolds. The first and second subsea manifolds may each be configured to receive production fluid from one or more subsea wells, respectively, via the one or more removable modules.

The first production pipeline and the second production pipeline may operate at the same and/or different working pressures. The installation may be configured to route production fluid into the first production pipeline and/or the second production pipeline depending upon the pressure of the well from which the production fluid originates.

Embodiments of the third aspect of the invention may include one or more features of the first to second aspects of the invention or their embodiments, or vice versa.

According to a fourth aspect of the invention, there is provided a subsea manifold for a subsea oil and gas production installation, the manifold comprising:

at least one fluid access point for a subsea well configured to be fluidly connected to a subsea well to receive production fluid therefrom;

a main flow bore configured to be in fluid communication with a subsea production pipeline; and a flowline connector for a jumper flowline, configured to be fluidly connected to a jumper flowline;

wherein the manifold defines a first flow path between the at least one fluid access point and the main flow bore and a second bypass flow path between the at least one fluid access point and the flowline connector for a jumper flowline, bypassing the main flow bore.

The first flow path and the second flow path may be fluidly connected and may be selectively separated by a flow barrier such as a valve.

The subsea manifold may be configured to be integrated into the production pipeline and the main flow bore may be configured to be continuous with the production pipeline. The subsea manifold may be in communication with the production pipeline via an inlet connector and an outlet connector of the subsea manifold, which may be configured to effectively integrate the subsea manifold into the production pipeline.

The at least one fluid access point may be configured to receive (i.e. be connected to) one or more removable modules. The at least one fluid access point may be a single bore access point. Alternatively, or in addition, the at least one access point may be a dual bore and/or a multi-bore access point. The at least one removable module may be a single bore, dual bore and/or multi bore module.

The one or more removable modules may comprise one or more flow access hubs. Alternatively, or in addition, the one or more removable modules may be one or more functional modules which may be configured to be connected to the manifold via one or more flow access hubs. The subsea manifold may be configured to be fluidly connected to at least one subsea well to receive production fluid therefrom via one or more removable modules connected to the at least one fluid access point. The one or more removable may be configured to receive the production fluid from the subsea well and route the production fluid into the subsea manifold. The one or more removable modules may be configured to and selectively route the production fluid into the first flow path and/or the second flow path of the subsea manifold. The one or more removable modules may comprise at least one valve which may be operable to selectively flow paths.

The subsea manifold may comprise one or more valves which may be provided to control the direction and route of flow and/or for flow assurance purposes (for example, to shut off a flowline or inlet/outlet when not in use).

Embodiments of the fourth aspect of the invention may include one or more features of the first to third aspects of the invention or their embodiments, or vice versa.

According to a fifth aspect of the invention, there is provided a subsea manifold for a subsea oil and gas production installation, the manifold comprising:

at least one fluid access point configured for connection to a connecting flowline carrying production fluid coming from another subsea manifold; and a main flow bore configured to be in fluid communication with a subsea production pipeline;

wherein the manifold defines a flow path between the at least one fluid access point and the main flow bore for routing the production fluid coming from the other subsea manifold into the production pipeline.

The at least one fluid access point may be a flowline connector for a jumper flowline. The at least one fluid access point may be configured to be fluidly connected to a further subsea manifold, wherein the further subsea manifold is connected to one or more subsea wells, to receive production fluid from the one or more subsea wells connected to the further subsea manifold.

The at least one fluid access point may be a fluid interface and may be configured to receive (i.e. be connected to) at least one removable module. The at least one removable module may comprise one or more flow access hubs. Alternatively, or in addition, the at least one removable module may be one or more functional modules which may be configured to be connected to the manifold via one or more flow access hubs. The at least one removable module may be configured to be fluidly connected to the further subsea manifold, wherein the further subsea manifold is connected to one or more subsea wells, to receive production fluid from the one or more subsea wells connected to the further subsea manifold and route the production fluid into the subsea manifold via the fluid access point. The removable module may be connected to the at least one fluid access point via a flow access hub. The flow access hub may comprise a flowline inlet bore for connection to the connecting flowline. The flowline inlet bore may comprise a flowline connector for the connecting flowline. Alternatively, or in addition, the flowline inlet bore of the flow access hub may be integrally formed with the connecting flowline. The connecting flowline may be a jumper flowline. The flow access hub may therefore be a part of a flowline jumper system, and therefore may be within the jumper envelope. The flow access hub may therefore be a flow access hub that can be deployed with the jumper system and/or retrieved from the manifold and subsea flow system with the jumper system, without causing disruption to the manifold or the wider flow system.

Alternatively, or in addition, the at least one fluid access point may be for a subsea well configured to be fluidly connected to a subsea well to receive production fluid therefrom.

Embodiments of the fifth aspect of the invention may include one or more features of the first to fourth aspects of the invention or their embodiments, or vice versa.

According to a sixth aspect of the invention, there is provided a method of controlling production flow from one or more subsea wells, the method comprising:

providing a subsea production system comprising:

at least one subsea well, a first production pipeline in fluid communication with a first subsea manifold and a second production pipeline in fluid communication with a second subsea manifold;

wherein at least one subsea well is connected to the first subsea manifold;

wherein the first subsea manifold and the second subsea manifold are fluidly coupled to one another by a connecting flowline; and wherein the first subsea manifold is provided with a flow control means operable to route the production fluid from the at least one subsea well into the first production pipeline via the first subsea manifold and/or into the second production pipeline via the second first manifold, the connecting flowline and the second subsea manifold.

The first production pipeline may have a first working pressure and the second production pipeline may have a second working pressure. The first working pressure and the second working pressure may be the same. The first working pressure and the second working pressure may be different. The method may comprise directing production flow from the at least one subsea well into the first or the second production pipeline depending on the pressure of the fluid produced from the well.

The method may comprise operating valves to select whether the production flow is directed into the first or the second production pipeline.

A first removable module may be connected to the first subsea manifold and a second removable module may be connected to the second subsea manifold. The removable module may be a flow access hub. Alternatively, or in addition, the removable module may be a functional module which may be configured to be connected to the manifold via a flow access hub. The first removable module may be fluidly connected to the at least one subsea well, which may be via a flow access hub. The method may comprise flowing production fluid from the at least one subsea well into the first removable module. The method may comprise operating valves provided in flow path or paths within the first removable module to select whether fluid is directed into the first or the second production pipeline.

The method may comprise directing fluid into the first production pipeline via the first subsea manifold. The method may comprise directing fluid into the second production pipeline via the first subsea manifold, the connecting flowline, a removable module to which the connecting flowline is coupled connected to the second subsea manifold and the second subsea manifold.

Embodiments of the sixth aspect of the invention may include one or more features of the first to fifth aspects of the invention or their embodiments, or vice versa.

According to a seventh aspect of the invention, there is provided a method of installing a distributed manifold system, the method comprising:

installing a first production pipeline and a first subsea manifold in fluid communication with the first subsea pipeline and installing a second subsea pipeline and a second subsea manifold in fluid communication with the second subsea pipeline, wherein the first subsea manifold comprises a fluid access interface and a flowline connector;

installing a connecting flowline between the first subsea manifold and the second subsea manifold, wherein the connecting flowline is connected at a first end to the flowline connector of the first subsea manifold;

fluidly connecting a removable module to the fluid access interface of the first subsea manifold, wherein the removable module is fluidly connected to at least one subsea well, such that production fluid from the at least one subsea well can be selectively routed into the first production pipeline via the removable module and the first subsea manifold or the second production pipeline via the removable module, the first subsea manifold, the connecting flowline and the second subsea manifold.

The removable module may be a flow access hub. Alternatively, or in addition, the removable module may be a functional module which may be configured to be connected to the manifold via a flow access hub. The method may comprise installing a flow access hub onto the fluid access point of the first subsea manifold. The subsea well may be connected to the removable module via the flow access hub. The subsea well may be fluidly connected to the flow access hub. The method may comprise installing the removable module to the flow access hub located on the fluid access interface of the first subsea manifold. The removable module may comprise flow control means operable to selectively route production fluid into the first production pipeline and/or the second production pipeline.

The installation method may be a staged installation method which may comprise connecting one or more subsea wells to the distributed manifold system in the future.

Embodiments of the seventh aspect of the invention may include one or more features of the first to sixth aspects of the invention or their embodiments, or vice versa.

According to an eighth aspect of the invention there is provided a flow access hub comprising:

a first interface comprising at least three bores;

a second interface comprising at least two bores; and a flowline inlet bore;

wherein the hub defines a first flow path between the flowline inlet bore and a first bore of the first interface, a second flow path between a second bore of the first interface and a first bore of the second interface and a third flow path between a third bore of the first interface and a second bore of the second interface.

The first interface may be an interface for connection to a removable module (a module interface). The second interface may be an interface for connection to a manifold (manifold interface). The first and second interfaces of the hub may be configured to fluidly connect with like interfaces of other components, equipment and/or structures.

The at least three bores of the first interface may be arranged adjacent to one another. The at least three bores of the first interface may be parallel.

The at least two bores of the second interface may be arranged adjacent to one another. The at least two bores of the second interface may be parallel.

Alternatively, the at least two bores of the second interface may be arranged concentrically. The first bore of the second interface may be arranged concentrically inside the second bore. Alternatively, the second bore of the second interface may be arranged concentrically inside the first bore.

The first interface may comprise parallel bores and the second interface may comprise concentric bores.

The hub may comprise a body. The body may be generally cylindrical. The first and second interfaces may be disposed on substantially opposite sides of the hub. The first and second interfaces may have their axes oriented substantially in a vertical plane. The first and second interfaces may have their axes oriented substantially in a horizontal plane. The flowline inlet bore may have its axis oriented substantially in the vertical plane. The flowline inlet bore may have its axis oriented substantially in the horizontal plane. The flowline inlet bore may have its axis radially oriented with respect to a main body of the hub. The flowline inlet bore may have its axis radially oriented with respect to a direction of the axis of a main body of the hub. The flowline inlet bore may have its axis radially oriented with respect to an axis of the first interface and/or an axis of the second interface.

The flowline inlet bore may comprise a flowline connector for a jumper flowline. The flowline inlet bore may be integrally connected to a jumper flowline.

Embodiments of the eighth aspect of the invention may include one or more features of the first to seventh aspects of the invention or their embodiments, or vice versa.

According to ninth aspect of the invention there is provided a flow access hub comprising:

a first interface comprising at least two bores;

a second interface comprising at least two bores; and a flowline inlet bore;

wherein the flowline inlet bore is configured to route flow into one or both of the at least two bores of the second interface.

The hub may define a first flow path between the flowline inlet bore a first bore of the first interface and a second flow path between a second bore of the first interface and a first bore of the second interface.

The at least two bores of the first interface may be arranged adjacent to one another. The at least two bores of the first interface may be parallel.

The first interface may comprise three bores and the second interface may comprise two bores. The hub may define a third flow path between a third bore of the first interface and a second bore of the second interface. The three bores of the first interface may be arranged adjacent to one another. The three bores of the first interface may be parallel. The two bores of the second interface may be arranged concentrically. The first bore of the second interface may be arranged concentrically inside the second bore. Alternatively, the second bore of the second interface may be arranged concentrically inside the first bore.

The first interface may comprise parallel bores and the second interface may comprise concentric bores.

The first and second interfaces of the hub may be configured to fluidly connect with like interfaces of other components, equipment and/or structures.

The flowline inlet bore may be configured to route flow into one or both of the at least two bores of the second interface via one or more modules fluidly connected to the first interface.

Embodiments of the ninth aspect of the invention may include one or more features of the first to eighth aspects of the invention or their embodiments, or vice versa.

According to a tenth aspect of the invention there is provided a flow access hub comprising:

an assembly comprising a first part comprising an interface, and a second part comprising a flowline connector;

wherein the interface comprises one or more flow openings, at least one of said flow openings oriented with a first longitudinal axis;

wherein the flowline connector has a second longitudinal axis inclined to the first longitudinal axis of the at least one flow opening;

wherein the first part is configured to be connected to a subsea flow apparatus by locating the interface at a first rotational orientation with respect the subsea flow apparatus; and wherein the second part is configured to be assembled with the first part in one of a range of azimuthal orientations about the first longitudinal axis such that the second longitudinal axis of the flowline connector is oriented at a required azimuthal orientation with respect to the subsea flow apparatus.

The flow access hub may be an indexed flow access hub in which the second longitudinal axis of the flowline connector/the flowline connector may be indexable between a range of azimuthal orientations.

The first rotational orientation between the interface of the first part and the subsea flow apparatus may be a fixed rotational orientation. That is, interface of the first part may only be connected to the subsea process apparatus in a certain rotational orientation (or in one of a number of discrete radial orientations). The rotational orientation may be fixed due to the position of the one or more flow openings of the interface and the requirement to fluidly couple and align the one or more flow openings of the interface with one or more corresponding flow openings of the subsea flow apparatus.

The second part may be assembled with the first part in a range of azimuthal orientations about the first longitudinal axis. Before assembly, one of the orientations may be selected before assembling the second part with the first part such that the second longitudinal axis of the flowline connector may be oriented at an optimum, desired azimuthal orientation with respect to the subsea flow apparatus. In this way, the flowline connector can be positioned in an optimum location with respect to the subsea flow apparatus to facilitate connection to a flowline.

The inventors have realised that, where the rotational orientation between part of a flow access hub and a subsea flow apparatus is fixed—for example, due to reasons of bore alignment between the two components—it is desirable to be able to adjust the position of a flowline connector of the flow access hub. In this way, the flowline connector can be optimally positioned with respect to the fixed flow access apparatus in a way which best suits the layout of the subsea field infrastructure. As the position of the flowline connector is flexible, it can be selected to facilitate a low stress, well-aligned connection between the flowline connector and a flowline. This may also have beneficial implications on load bearing, flow rates, flowline lengths and the complexity of the subsea field infrastructure.

The subsea flow apparatus may be a manifold. The subsea flow apparatus may be a subsea manifold selected from the group comprising: a subsea collection manifold system, a subsea well gathering manifold, a subsea in-line tee (ILT), a subsea Pipe Line End Manifold (PLEM), a subsea Pipe Line End Termination (PLET) and a subsea Flow Line End Termination (FLET).

The interface may be a first interface. The first part may further comprise a second interface. The first part may define a first flow path between the flowline connector and the first interface and/or the second interface of the first part. The at least one flow opening of the first interface may be configured to be fluidly connected to at least one flow opening of the subsea flow apparatus. The second interface of the first part may comprise at least two flow openings. The first flow path may be defined between the flowline connector and one of the at least two flow openings of the second interface of the first part. The first part may define a second flow path between a second of the at least two flow openings of the second interface and the at least one flow opening of the first interface.

The second interface of the first may be configured to be connected to a subsea process apparatus, such as a functional module. The flow access hub may define one or more flow paths between a subsea process apparatus and the subsea flow apparatus in use.

The first part of the flow access hub may be a body. The second part of the flow access hub may be a conduit. A first end of the conduit may be coupled to the first part of the flow access hub and a second end of the conduit may form the flowline connector.

The second part may be rigidly connected to the first part. The second part may be welded to the first part.

The second part may be moveably and/or adjustably connected to the first part such that the azimuthal orientation of the second longitudinal axis of the flowline connector with respect to the subsea flow apparatus is adaptable, once the second part is assembled with the first part. The second part may be coupled to the first part by a flanged connection. The second part may be coupled to the first part by a threaded connection. The second part may be coupled to the first part by a clip which facilitates relative movement between the first part and the second part.

The first part may comprise a cut out section to accommodate the second part.

The flowline connector may be configured for connection to a flowline carrying fluid from a subsea well. The flowline connector may comprise a flowline connector for a flowline configured to carry fluid from a subsea well, which may be a jumper flowline. Alternatively, or in addition, the flowline connector of the flow access hub may be integrally formed with a flowline configured to carry fluid from a subsea well. The flow access hub may therefore be a part of a flowline jumper system, and therefore may be within the jumper envelope. The flow access hub may therefore be a flow access hub that can be deployed with the jumper system and/or retrieved from a manifold and subsea flow system with the jumper system, without causing disruption to the manifold or the wider flow system.

Embodiments of the tenth aspect of the invention may include one or more features of the first to ninth aspects of the invention or their embodiments, or vice versa.

According to an eleventh aspect of the invention there is provided a flow access hub comprising:

an assembly comprising:

a first part comprising a first interface; and a second part comprising a flowline connector for a jumper flowline;

wherein the first interface comprises one or more flow openings, at least one of said flow openings oriented with a first longitudinal axis;

wherein the flowline connector for a jumper flowline has a second longitudinal axis inclined to the first longitudinal axis of the at least one flow opening;

wherein the first part is configured to be connected to a subsea manifold by locating the first interface at a first rotational orientation with respect to the subsea manifold; and wherein the second part is configured to be assembled with the first part in one of a range of azimuthal orientations about the first longitudinal axis such that the second longitudinal axis of the flowline connector for a jumper flowline is oriented at a required azimuthal orientation with respect to the subsea manifold.

The inventors have realised that, where the rotational orientation between part of a flow access hub and a subsea manifold is fixed—for example, due to reasons of bore alignment between the two components—it is desirable to be able to adjust the position of a flowline connector for a jumper flowline. In this way, the flowline connector for a jumper flowline can be optimally positioned with respect to the fixed flow access apparatus and subsea manifold in a way which best suits the layout of the subsea field infrastructure. As the position of the flowline connector for a jumper flowline is flexible, it can be selected to provide an optimum jumper departure angle for a jumper flowline with respect to the manifold to facilitate a low stress, well-aligned connection between the flowline connector for a jumper flowline and a jumper flowline. This may also have beneficial implications on load bearing, flow rates, flowline lengths and the complexity of the subsea field infrastructure.

Embodiments of the eleventh aspect of the invention may include one or more features of the first to tenth aspects of the invention or their embodiments, or vice versa.

According to a twelfth aspect of the invention there is provided a subsea flow system comprising a subsea manifold, a jumper flowline and a flow access hub according to a tenth or an eleventh aspect of the invention.

The interface of the first part of the hub may be connected to the subsea manifold. The flowline connector of the second part of the hub may be connected to the jumper flowline.

Embodiments of the twelfth aspect of the invention may include one or more features of the first to eleventh aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

The terms "upper", "lower", "above", "below", "up" and "down" are used herein to indicate relative vertical positions in vertical orientations of flow system components. The invention also has applications in horizontal orientations, and when these terms are applied to such orientations they may indicate "left", "right" or other relative positions in the context of the orientation of flow system components.

Figure 1:
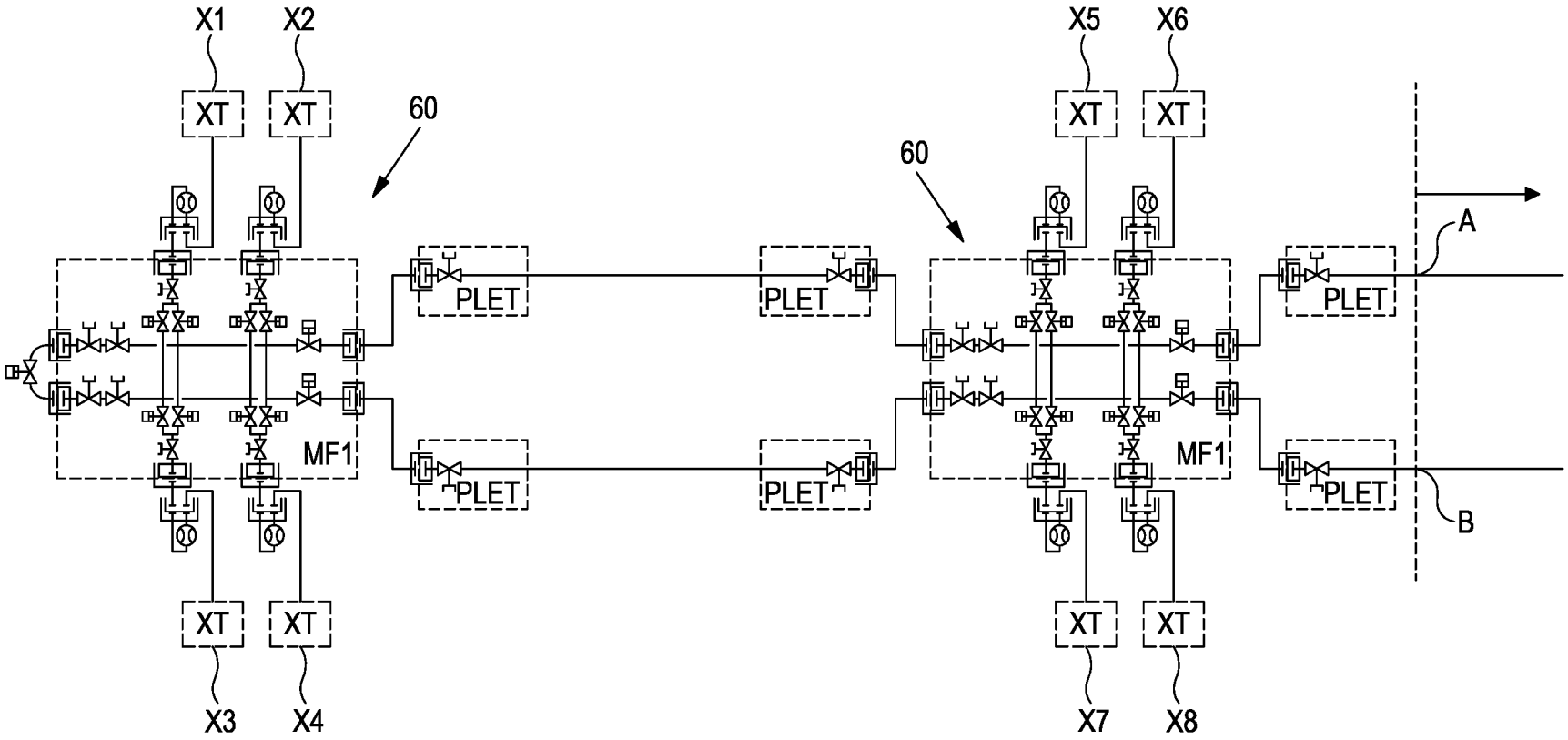
FIG. 1 is a piping and instrumentation diagram of a subsea system useful for understanding the invention.

Referring firstly to FIG. 1, there is shown a subsea system comprising traditional subsea components, which is useful for understanding the invention. The system contains two four-slot manifolds 60, each capable of connecting to up to four subsea wells, X1, X2, X3, X4, X5, X6, X7 and X8. The production fluid from the wells is routed through the manifolds and into either production flowline A or production flowline B. These types of manifolds are large and heavy. They require a large CAPEX investment for a reasonably low well count, they require specialist installation using specialist vessels and equipment due to their substantial size and weight and they restrict where the top-hole locations of subsea wells can be drilled.

Figure 2A:
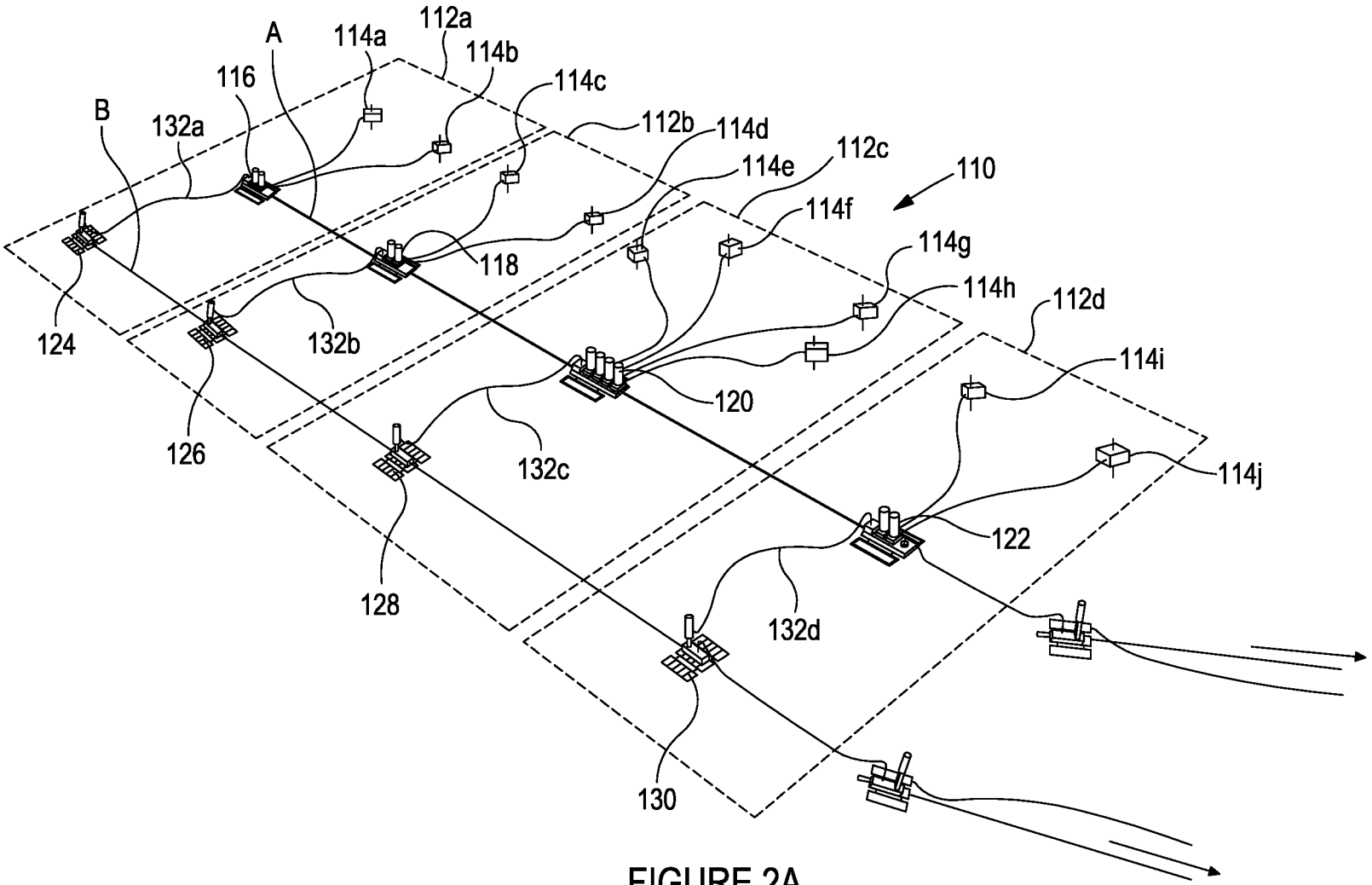
FIG. 2A is a schematic perspective view of a subsea system according to an embodiment of the invention.
Figure 2B:
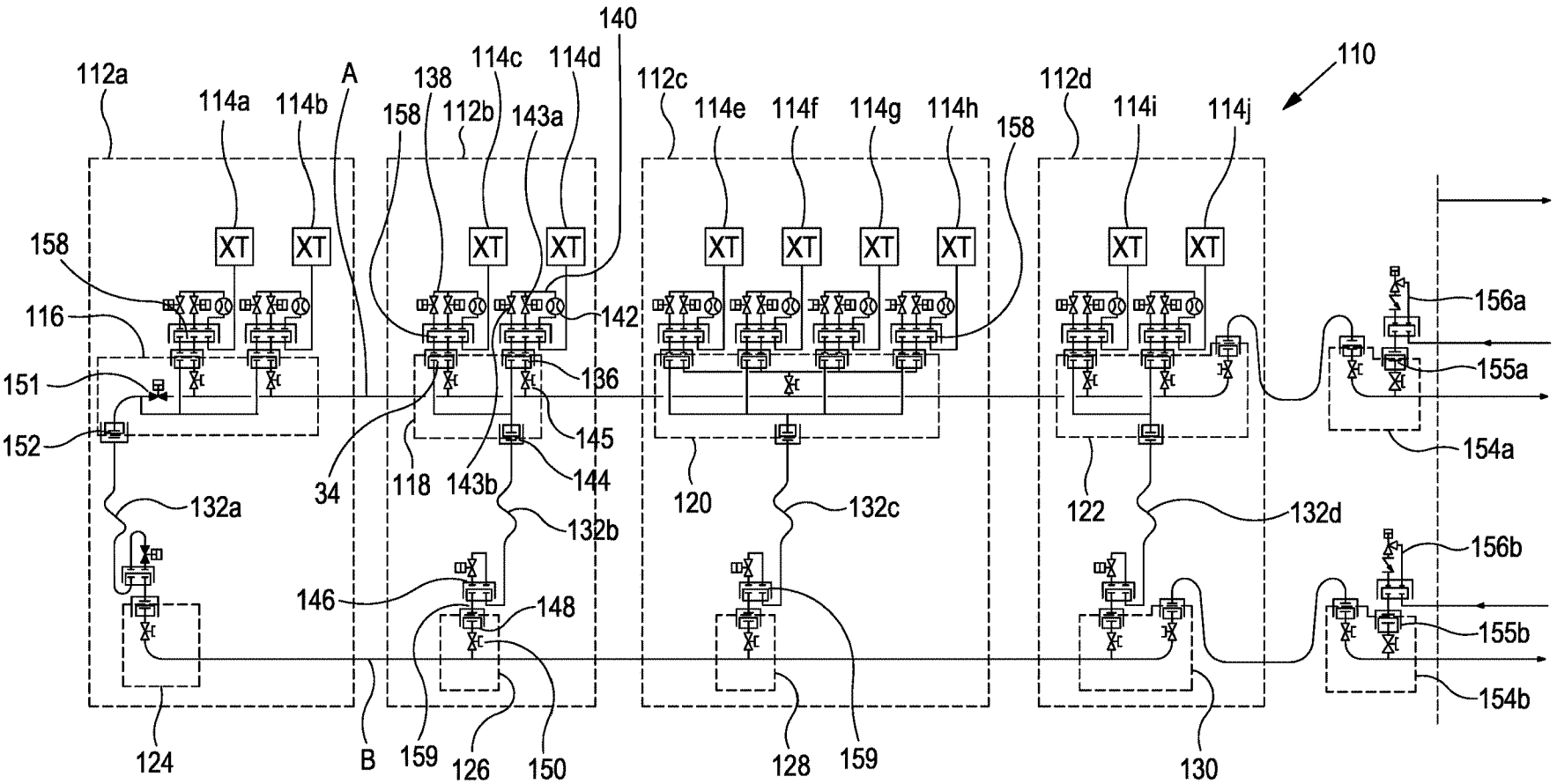
FIG. 2B is a piping and instrumentation diagram of the system of FIG. 2A.

Referring to FIGS. 2A and 2B, there is shown, generally at 110, a distributed manifold system according to an embodiment of the invention.

A distributed manifold system comprises a collection of manifolds, displaced from one another and fluidly connected together. In the example shown in FIGS. 2A and 2B these manifolds are in-line tees (ILTs) and Pipe Line End Terminations (PLETs). A distributed manifold system can function in the same manner as a conventional well gathering manifold, but instead its components and connection points are distributed over a pipeline system. A distributed manifold can be selectively populated and utilised as and when project requirements demand. This kind of system also provides utmost flexibility to subsea architecture (for example, allowing a well top-hole to be drilled in an optimal position and served by a specifically located manifold within the distributed system; whereas typically, top-hole location is influenced by the fixed location of existing subsea infrastructure).

The system of FIGS. 2A and 2B is made up of four drill centres, shown generally by the shaded areas 112*a*, 112*b*, 112*c* and 112*d*, each bordered by dashed lines. Within each drill centre, a number of subsea wells are connected to a manifold of the system. In drill centre 112*a*, which is the outermost drill centre in the system, subsea Christmas trees 114*a* and 114*b* are fluidly connected to a PLET 116 by a pair of flexible jumper flowlines. In drill centre 112*b*, two subsea Christmas trees 114*c* and 114*d* are connected to an ILT 118. In drill centre 112*c*, four subsea Christmas trees 114*e* to 114*h* are connected to a four-slot ILT 120. Finally, in drill centre 112*d*, Christmas trees 114*i* and 114*j* are fluidly connected to PLET 122.

The system has two main production flowlines: production flowline A and production flowline B. Production flowlines A and B each lead comingled fluid produced from various subsea wells to a separate production riser (not shown), in the direction indicated by the arrows. The manifolds 116, 118, 120 and 122 are integrated into production flowline A, and each comprise a main flow bore which is continuous with flowline A. Each of the manifolds 116, 118, 120 and 122 is connected to a respective PLET or ILT 124, 126, 128, 130, which is similarly integrated into flowline B, by a flexible jumper flowline 132*a*, 132*b*, 132*c*, 132*d*. This arrangement allows for fluid coming from the subsea wells via any of the Christmas trees 114*a* to 114*j* to be selectively routed into either production flowline A or production flowline B. A production flowline may, for example, be selected based on the pressure of the fluid originating from the well in question and the pressure of the production flowlines.

FIG. 2B shows in more detail how fluid connections are made to the manifolds 116, 118, 120, 122, 124, 126, 128, 130 in the system. For example, with reference to the ILT 118 in drill centre 112*b* in communication with production flowline A, it can be seen that the ILT 118 comprises two fluid access points 134 and 136 having dual bore interfaces. Connected to each of these access points 134, 136 there is a flowline connector hub 158. The purpose of the hub 158 is to connect a subsea well to the manifold and provide a fluid access interface for connection of the well and the ILT 118 with one or more functional removable modules. The hub 158 is therefore a part of the flowline jumper system, and therefore within the jumper envelope. The hub can therefore be deployed with the jumper system and/or retrieved from the ILT 118 and subsea flow system with the jumper system, without causing disruption to the ILT 118 or the wider flow system. The hub can therefore provide a fluid access and intervention location within the jumper flowline envelope. The flowline connector hub 158 comprises a dual bore interface lower which mates with the dual bore interface of the fluid access points, a flowline inlet bore which is fluidly coupled to the Christmas trees 114*c* and 114*d* via a flexible jumper flowline, and a triple bore upper interface. The hub 158 defines two respective flow paths between the two bores of its lower interface and two bores of its upper interface and a third flow path between the flowline inlet bore and the third bore of its upper interface. The flowline inlet bore forms a connection point for a flowline, to receive production fluid from a subsea well. In embodiments of the invention, the hub could be integrally formed with the end of a flowline, such as a jumper flowline connected to or configured to be connected to receive fluid from a subsea well. Although in the presently described embodiment the hub 158 does not comprise any additional components, it will be appreciated that the hub 158—or any of the flowline connector/flow access hubs described throughout this specification—may include one or more valves for selectively routing fluid in the system in substantially the same manner as described in more detail below with reference to operation of removable module 140.

In the embodiment of FIG. 2B, each hub 158 provides a landing and connection point for removable functional modules 138 and 140. Each of the removable modules 138 and 140 has a triple bore interface which is fluidly connected to the triple bore interface of the hub 158. In each case, two bores of the triple bore interface of the removable modules 138 and 140 are fluidly connected to two of the bores of the hubs 158 upper interface, whilst the third bore is fluidly coupled to the third bore of the hub 158 which corresponds to the flowline inlet bore and thus connected Christmas trees 114*c* and 114*d* via a flexible jumper flowline. The Christmas trees 114*c* and 114*d* are not connected directly to the ILT 118 but are instead fluidly connected to the ILT 118 via the removable modules 138 and 140 and hubs 158. Without the removable modules present (for example, if the hubs 158 were to have blind flow caps installed on their upper interfaces) there would be no way for fluid to flow from the wells connected to the subsea trees 114*c* and 114*d* to the ILT 118.

The removable modules 138 and 140 are, in this case, identical. For conciseness, only the function of module 140 is described. The module 140 receives fluid from the tree 114*d* via an inlet bore and comprises a multiphase flow meter 142 through which all production fluid from the tree is routed. The flow path within the module 138 then splits into two branches, either of which can be selected by operation of valves 143*a* and 143*b*, to selectively route fluid into either production flowline A or production flowline B, respectively. The ILT 118 comprises a flowline connector for a jumper flowline 144 to which flexible jumper flowline 132*b* is connected. From each of its fluid access points 134 and 136, the ILT defines a flow path which connects one bore of the dual bore interface to its local flowline: production flowline A. For flow assurance reasons, each of these flow paths comprise a valve 145; however, it will be appreciated that this may be omitted or replaced with an equivalent component in alternative embodiments. From each of its fluid access points 134 and 136, the ILT also defines a flow path connecting the other bore of the dual bore interface directly to the jumper flowline connector 144, effectively bypassing the main flowline A and therefore routing flow towards production flowline B via the jumper flowline 132*b*, a removable module 146 provided on the ILT 126 (described below), and the ILT 126.

ILT 126 is similar to the ILT 118; however, it has only a single fluid access point 148 having a single bore interface. Connected to the access point 148 there is a flowline connector hub 159. The purpose of the hub 159 is to connect the flow originating from the subsea wells 114*c* and 114*d* to the ILT 126, and to provide a fluid access interface to facilitate connection of the subsea wells 114*c* and 114*d* and the ILT 126 to one or more removable modules. The flowline connector hub 159 comprises a lower single bore interface which mates with the fluid access point 148, a flowline inlet bore which is fluidly coupled to the jumper flowline 132*b*, and a dual bore upper interface. The hub 159 defines a first flow path between the bore of its lower interface and a bore of its upper interface and a second flow path between the flowline inlet bore and the second bore of its upper interface. The flowline inlet bore could form a connection point for a flowline, or the hub could be integrally formed on the end of a flowline.

A removable module 146 having a dual bore interface is fluidly to the hub 159, and is thereby operable to receive fluid produced from the wells corresponding to subsea Christmas trees 114*c* and 114*d*. A valve 119 (which in alternative embodiments may be omitted) is provided in the flow loop of the removable module 146 to selectively permit fluid to enter production flowline B. A valve 150 is also provided in the ILT 126 for flow assurance and connection purposes.

The description of the arrangement and operation of drill centre 112*b* generally applies to each of the drill centres depicted in FIGS. 2A and 2B, with relatively minor differences. For example, in drill centre 112*c* a 4-slot ILT 120 is provided, having an alternative flow path configuration within the ILT.

It will be appreciated that alternative removable modules may be used, and that the alternative modules may be provided with additional flow components, flow control elements, flowlines, fluid access points, instrumentation (such as pressure and temperature sensors) and/or valves and/or they may be provided without these components to provide a simple flow loop without obstruction. It will also be appreciated that the manifolds 124, 126, 128, 130 in communication with production flowline B may be replaced with different manifolds in alternative embodiments of the invention, which are also capable of being connected to subsea wells (like manifolds 116, 118, 120 and 122).

The two PLETs 116 and 124 which are provided in drill centre 112*a* are the outermost components in the distributed manifold system. The PLETs 116 and 124 are also connected by a jumper flowline 132*a*. The PLET 116 comprises a valve 151 in the bore continuous with production flowline A which can be operated to shut off the flowline—for example, to facilitate the connection of a pigging device to the system. A pigging device could be installed between the flowline 132*a* and connector 152 of the PLET 116. The flow loop created by the distributed manifold system is able to support bi-directional pigging, and/or round trip pigging from a platform or other remote facility via the production flowlines A and B.

Drill centre 112*d* is the final drill centre in the distributed manifold system, before the production fluid is recovered to the surface via production risers (not shown). Each production pipeline A and B is routed through a riser base module 154*a* and 154*b*. Each riser base module 154*a* and 154*b* also comprises a fluid access points 155*a* and 155*b* having single bore interfaces, on which flowline connector hubs and dual bore interface removable modules 156*a* and 156*b* are mounted. These are gas lift modules, which each comprise a flow loop having a gas lift injection choke. Although in alternative embodiments an orifice may be used in place of a choke valve. One bore of each of the modules 156*a* and 156*b* is connected to the single bore interface of the riser base module whilst the other is connected to a gas lift delivery line to receive gas for gas lift operations. The modules 156*a* and 156*b* can be operated to inject gas into the flow of production fluid from production pipelines A and/or B at the base of the riser in order to reduce its density and to make it easier to recover to the surface.

The flowline connector hubs 158 and 159 can transform a dual or single bore interface of a fluid access point of a manifold into a triple or dual bore interface, respectively. An example of a dual to triple bore flowline connector hub is described with reference to FIGS. 12A to 12C. In addition, the flowline connector hubs are a part of the flowline jumper system and are therefore within the jumper envelope. The flowline connector hubs can be deployed with the jumper system and/or retrieved from the manifolds in the distributed manifold system and the subsea flow system with the jumper system, without causing disruption to the manifold(s) or the wider flow system.

Figure 2C:
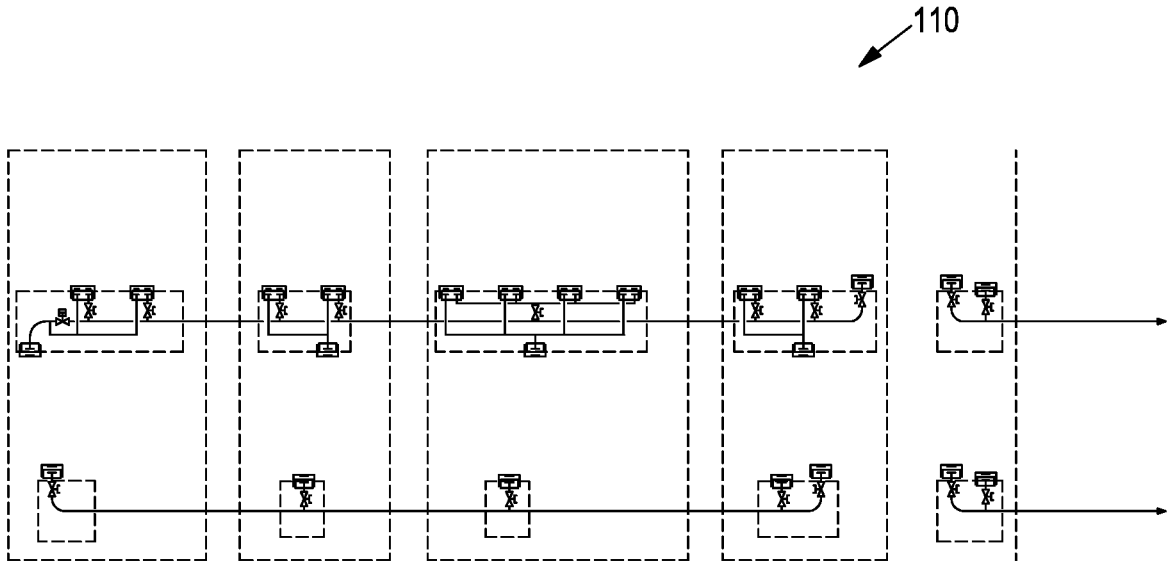
FIG. 2C is a piping and instrumentation diagram of the system of FIGS. 2A and 2B, prior to population.

FIG. 2C shows the system of FIGS. 2A and 2B, before connection and completion. At this stage, the system 210 is not connected to any subsea wells nor is it connected to the wider production flow system including production risers. An advantage of the distributed manifold system is that the fundamental core components of the system, including those included in the incomplete system of FIG. 2C, can be installed along with other subsea infrastructure (for example, integrated with a pipeline during a pipelay operation). At a later stage, additional components, including connecting flowlines and removable modules, can be installed in the system if they are required. As these components are smaller and lighter than a full-size traditional well gathering manifold, they can be installed using ROVs and/or other suitable equipment and do not require the use of specialist installation vessels. The distributed manifold system also provides flexibility with respect to subsea field development, as the system provides multiple locations at which to connect subsea wells to the system as and when they are developed, and can be easily adapted to provide new connection points for wells at optimal locations on the seabed, with the provision of a small number of connection components.

Figure 2D:
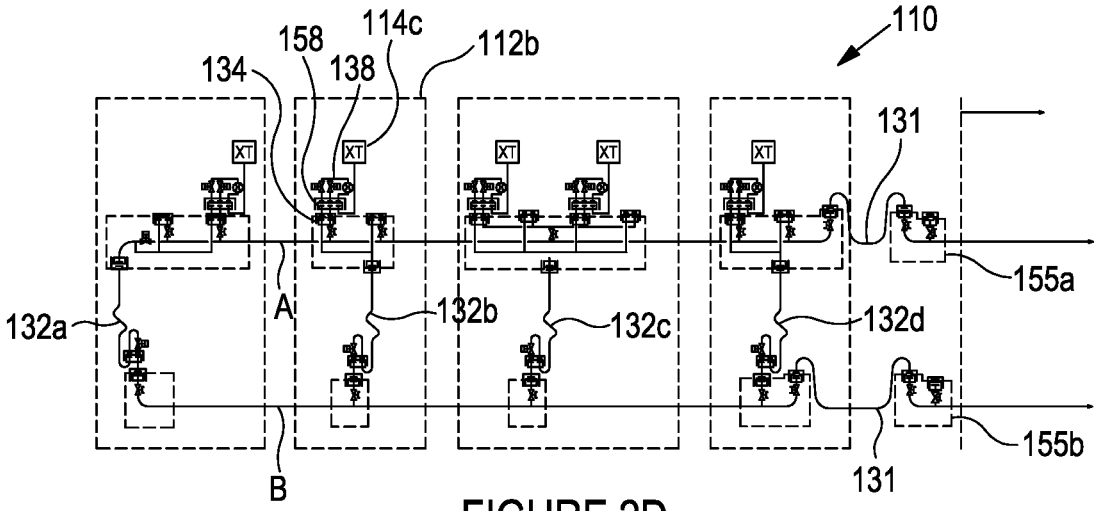
FIG. 2D is a piping and instrumentation diagram of the system of FIGS. 2A, 2B and 2C, partially populated.

FIG. 2D shows the system 110 in a partially populated state. The system of FIG. 2D is equipped with flowlines 132*a*, 132*b*, 132*c*, 132*d* connecting the manifolds of the system together and flowlines 131 connecting production flowline headers A and B to the riser base modules 155*a* and 155*b*, respectively, to enable flow to travel from subsea wells connected to the manifolds of the system to either of production pipelines A or B. However, in the absence of removable modules connected to the PLETs and ILTs of the system (as well as to the riser base modules), there is no complete flow loop through which flow can travel.

With reference to drill centre 112*b* for example, one subsea well Christmas tree is fluidly connected to fluid access point 134 of the ILT 118 via the hub 158 and the removable module 138. As such, flow from the associated subsea well can be routed into production flowlines A or B by use of the module 138. As noted above, flow cannot be routed into the production risers until a removable module is connected to the riser base modules 155*a* and 155*b* to complete the flow path.

Multiple subsea wells have been connected to other manifolds within the system and unconnected fluid access points (also referred to as slots) are available for the connection to subsea wells in the future, should they be required.

FIGS. 3A to 3I show a connection sequence for connecting subsea wells to a manifold of a distributed manifold system. The manifold is a subsea in-line tee 218 integrated into a production pipeline A. The ILT 218 was laid on the sea bed along with the production pipeline A by a pipelay vessel and has an integral mud mat 253 which has been folded out to support the ILT on the seabed.

Figures 3A, 3B, 3C, 3D:
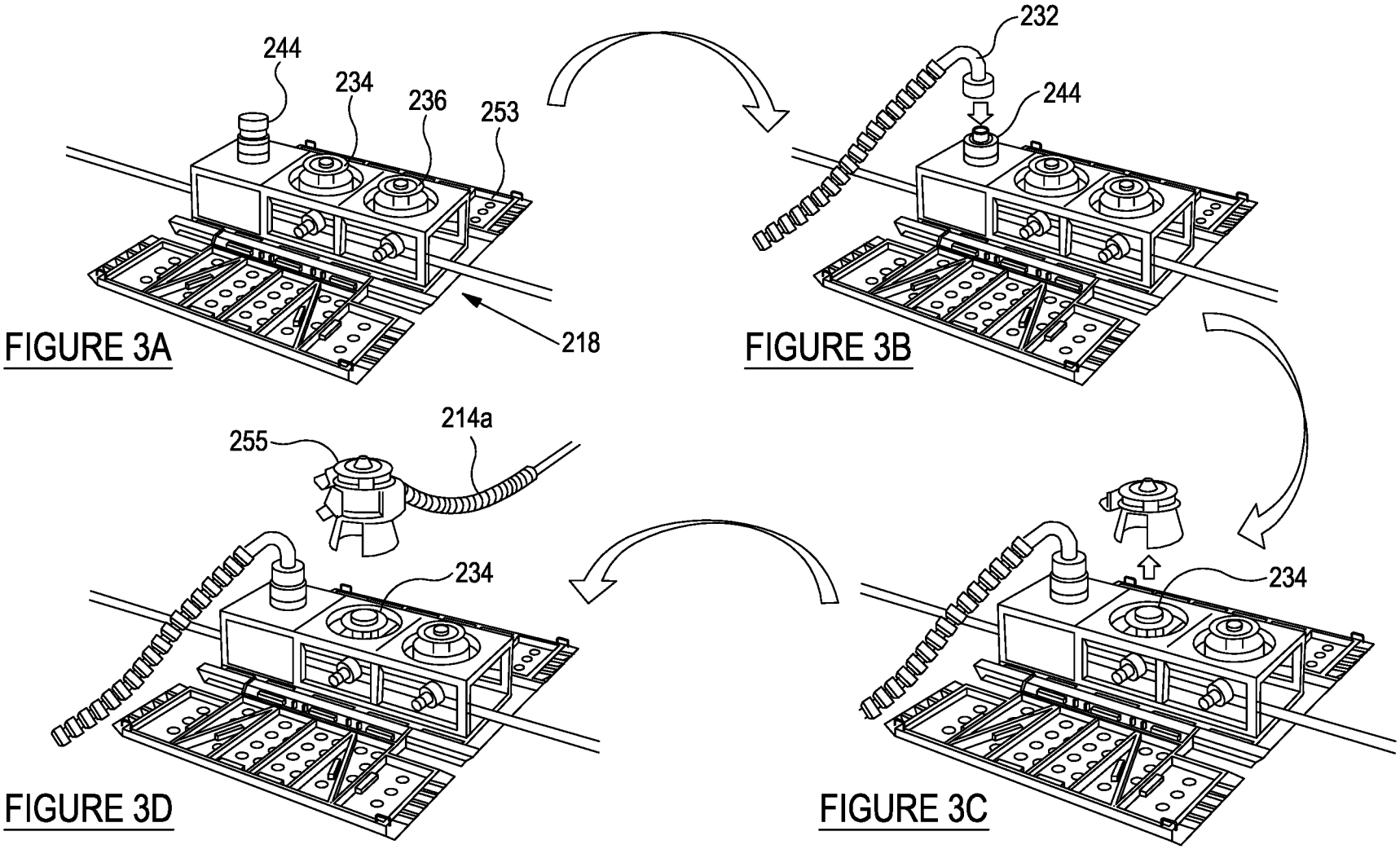
FIGS. 3A to 3I are schematic perspective views of the installation process of a manifold of the system according to an embodiment of the invention.

The ILT 218 has two fluid access points 234 and 236, each having a dual bore interface (not shown). In FIG. 3A the fluid access points 234 and 236 are closed with flow caps. The ILT also has a flowline connector for a jumper flowline 244. Each of the fluid access points 234 and 236 is fluidly connected to production flowline A by one or more flow paths defined by the manifold (not shown) corresponding to one of the bores of each dual bore interface, and the flowline connector 244 by one or more flow paths defined by the manifold (not shown) corresponding to the other bore of each dual bore interface.

FIG. 3B shows the process of a jumper flowline 232 being connected to the flowline connected 244 of the ILT 218. Installation of the jumper can be performed using an ROV or similar and does not require heavy-duty or specialist deployment vessels. The jumper flowline 232 will connect the ILT to another manifold within the distributed manifold system, or perhaps to a removable module connected to and mounted on another manifold.

In FIG. 3C, the flow cap is removed from the fluid access point, exposing its dual bore interface.

Figures 3E, 3F, 3G, 3H, 3I:
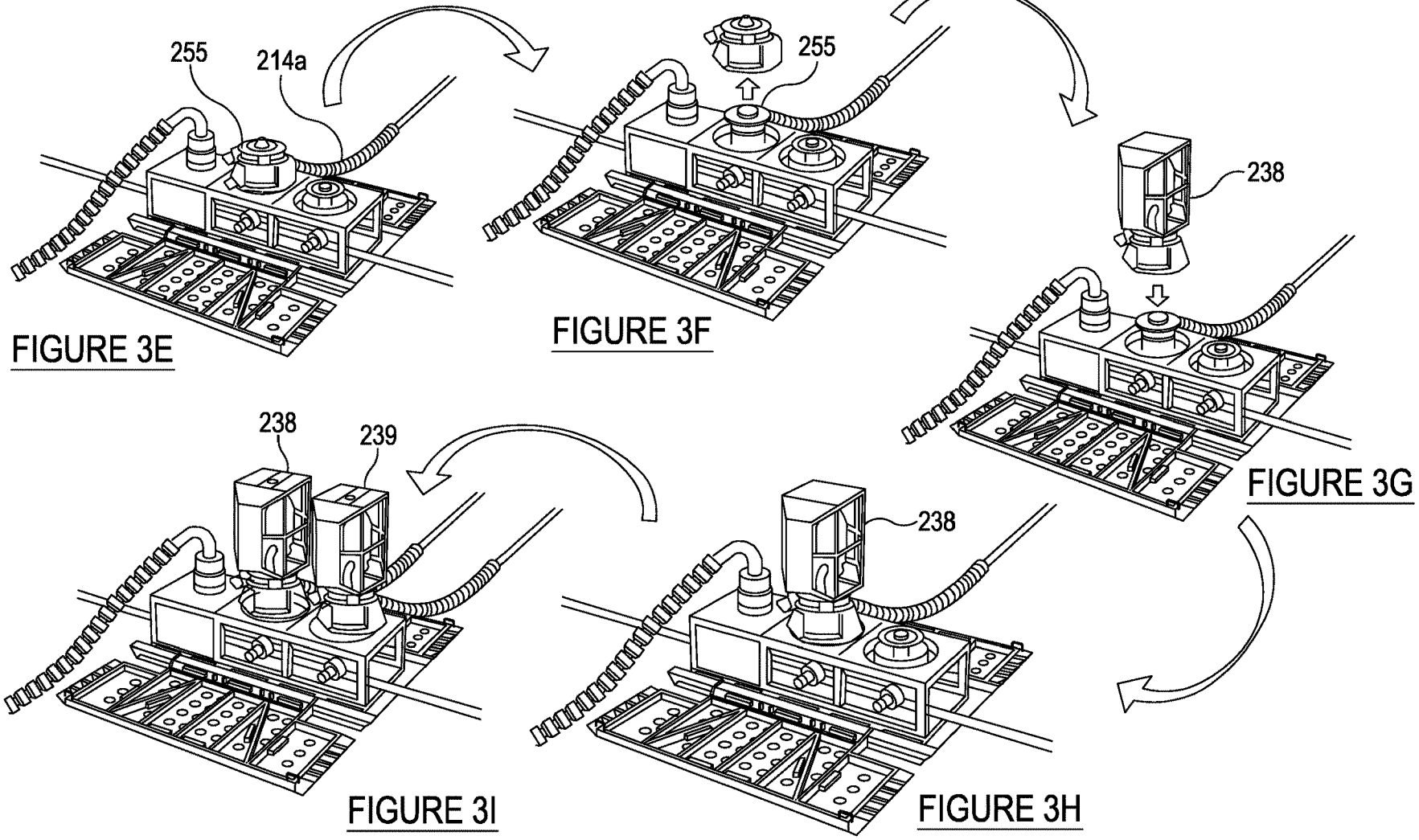

FIG. 3D shows the step of connecting a subsea well to the fluid access interface 234 via flowline 214*a* having an associated flowline connector hub 255 and FIG. 3E shows the completed connection. The flowline connector hub 255 has a lower dual bore interface (not shown) which is aligned with the dual bore interface of the fluid access point 234 upon connection. The flowline connector hub 255 also has a flowline inlet bore. The flowline 214*a* and the connector hub 255 may be integral components and/or may be detachable. The upper interface of the flowline connector hub 255 is a triple-bore interface, having two bores corresponding to the dual bore interface of the fluid access point 234 and a third bore corresponding to the flowline 214*a*. The triple-bore upper interface cannot be seen in FIG. 3E, as a flow cap is positioned on the connector hub 255. As such, no flow can take place between the well and the ILT.

In FIG. 3F, the flow cap is removed to expose the triple-bore upper interface of the flowline connector hub 255. A removable module is now able to be connected to the ILT, as is shown in the step of FIG. 3G. The removable module 238 has a triple-bore lower interface to communicate with the triple-bore upper interface of the flowline connector hub 255. The removable module connection is complete in FIG. 3H. The removable module defines a flow path between the flowline inlet bore and one other bore of its triple-bore lower interface, and a flow path between the flowline inlet bore and the other bore of its triple-bore lower interface. As such, fluid can now flow from the well via the flowline 214*a*, through the removable module and into either: (a) the flowline 232 (on route to a second production flowline) via the flowline connector 244 or (b) into production flowline A, depending upon how valves (not shown) within in the removable module are operated.

FIG. 3I shows the ILT after the steps of FIGS. 3C to 3H have been repeated to install a second removable module 239 upon the fluid access point 236 of the ILT 218. Like the jumper flowlines, installation of the removable modules can be performed using an ROV or similar and does not require heavy-duty or specialist deployment vessels. Advantageously, if a component within the removable module fails—for example, a multiphase flow meter—only the module needs to be recovered. Not the entire ILT.

FIGS. 4A, 4B, 5 and 6 are examples of removable modules that can be used with the system.

Figure 4B:
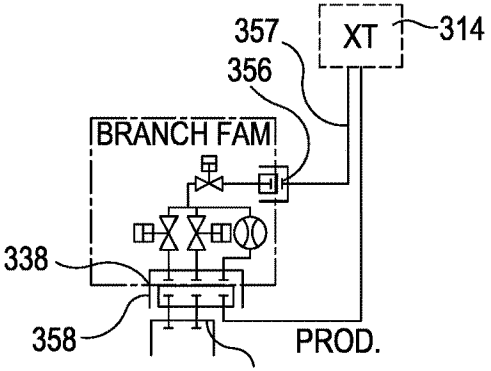
Figure 4A:
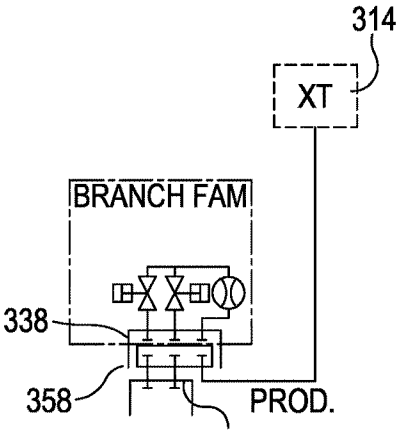

The removable module 338 of FIG. 4A has a triple-bore lower interface connected to a triple bore upper interface of flowline connector hub 358. Two of the bores of the flowline connector hub 358 are fluidly connected to the dual-bore interface 334 of a manifold, whilst the third receives production fluid from a Christmas tree 314. The module 338 functions to selectively route fluid received from the tree 314 into either one (or both) of the bores of the dual bore interface of the manifold's fluid access point.

The removable module 388 of FIG. 4B has an additional access point 356, which is capable of being connected up by a line 357 for venting, chemical injection and/or well control purposes and/or for the provision of pressure and/or temperature transducers.

Figure 5A:
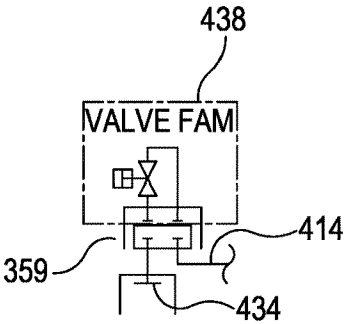

The removable module 438 of FIG. 5A contains a simple flow loop to connect fluid entering the flowline connector hub 359 from a flowline 414 to a single bore fluid access point interface 434 of a manifold. The flow loop contains a valve for flow assurance and/or control purposes.

Figure 5B:
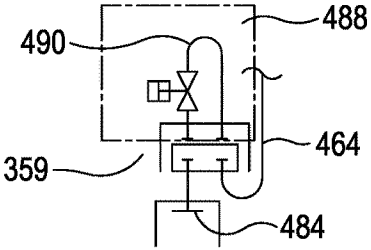

The removable module 488 of FIG. 5B is similar to the module 438 of FIG. 5A, and contains a simple flow loop to create a flow path between respective bores of the flowline connector hub 359, for example to enable a fluid flow from a flowline 464 to a single bore fluid access point interface 484 of a manifold. The flow loop also contains a valve for flow assurance and/or control purposes, but differs from the module 438 in that the flow loop is piggable, to enable pigging of the flow path and/or round trip pigging around the system in which it is installed.

Figure 6:
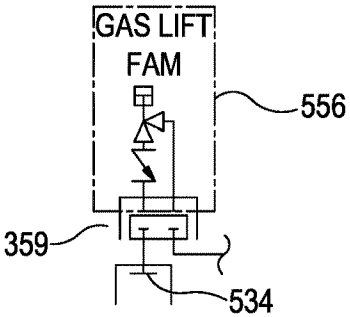
FIGS. 4 to 6 are schematic piping and instrumentation diagrams of removable modules according to alternative embodiments of the invention.

The removable module 556 of FIG. 6 is a gas lift module, like that described with reference to FIG. 2B, and variations may contain a gas lift venturi or a gas lift choke valve, depending on operational requirements.

Figure 7:
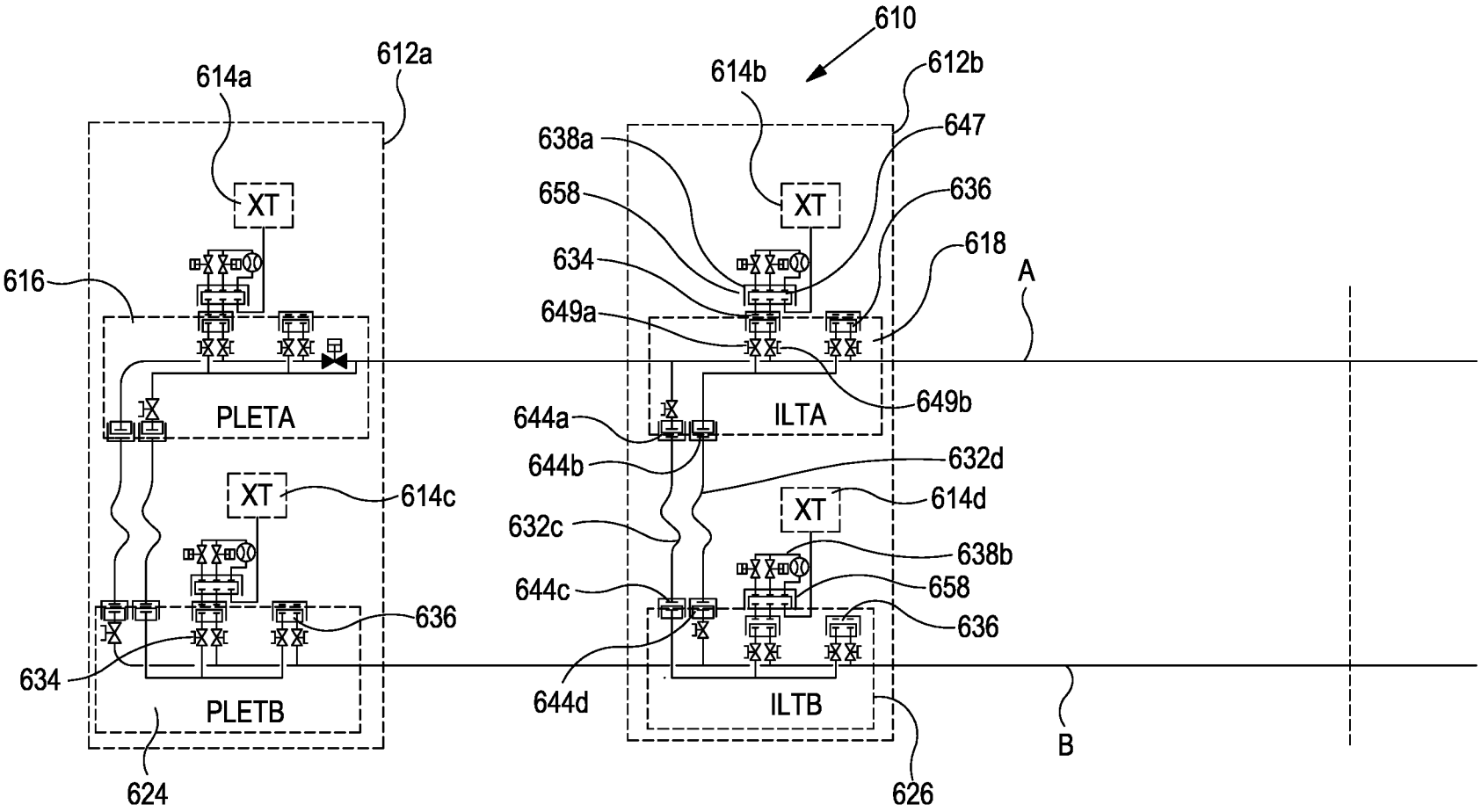
FIG. 7 is a piping and instrumentation diagram of a subsea system according to an embodiment of the invention.

Referring to FIG. 7, an alternative configuration of a flow system according to an embodiment of the invention is shown. This system allows production fluid flowing from a subsea well to be routed into either of production flowlines A or B. The system 610 is similar to the system 110 of FIGS. 2A and 2B, with like features indicated by like reference numerals, incremented by 500. The system 610 differs from the system 110 in that subsea wells are connected to manifolds integrated in both production flowlines A and B, as opposed to only being connected to the production flowline A side of the distributed manifold system. In addition, there are only two drill centres 162*a* and 612*b* in the embodiment of FIG. 7.

In the embodiment shown, the flow system comprises four manifolds: two PLETs 616 and 624 in the outermost drill centre 612*a* and two ILTs 618 and 626 in the drill centre 612*b*. Each manifold 616, 618, 624, 626 has two fluid access points 634 and 636 and is capable of being connected to and receiving production fluid from up to two subsea wells. However, in the embodiment shown, only a single subsea well Christmas tree 164*a*, 614*b*, 614*c*, 614*d* is connected to each manifold 616, 618, 624, 626.

The main differences in system configuration can be described with reference to drill centre 612*b*, where it can be seen that the two ILTs 618 and 626 each have two jumper flowline connectors 644*a*, 644*b*, 644*c* and 644*d* and are fluidly connected to one another by two jumper flowlines 632*c* and 632*d*.

A removable flow-through module 638*a* is connected to the ILT via the fluid access point interface 634 and flowline connector hub 658, providing flow routes between the well connection point 647 and flow bores 649*a* and 649*b* of the ILT 618 which are in fluid communication with production flowlines A and B, respectively. The flow paths within the removable module 638 each has a valve. As such, fluid produced from the well and entering the module 638 can be selectively routed through the flow paths 649*a* or 649*b* of the ILT 618, and thus production flowlines A or B (via jumper flowline 632*d*) by operation of the valves in the removable module. The opposite ILT 626 functions to direct flow in a similar manner. A subsea Christmas tree 614*d* is connected to the ILT 626 via removable module 638*b* and hub 658. By operating the valves within the removable module 638*b* fluid produced from the well 614*d* and entering the module 638*b* can be selectively routed through the flow paths of the ILT 626, and thus production flowlines B or A (via jumper flowline 632*c*).

The ILT 618 also comprises a second interface 636, for the connection of a further subsea well in the future. A flow cap is shown installed on the second interface 636 whilst it is not currently in use.

It will be appreciated that although each manifold is described as having two interfaces—and therefore being able to accommodate the connection of two subsea fluid sources (subsea well Christmas trees in this embodiment)—manifolds within a distributed manifold system may be provided with more or less interfaces to accommodate different numbers of subsea wells and future subsea expansion plans.

The fluid access interfaces provided formed by the hubs 658 provide a convenient interface upon which to land and connect one or more removable flow modules to the system. The flow modules may merely facilitate the provision of a flow path between a subsea well and the first and/or second production flowlines, or they can provide the system with additional functionality. For example, an alternative flow module might comprise pressure and temperature transducers to obtain measurements of the production fluid flowing from the well.

As the modules 638 are removably connected to the hub interfaces—the hubs being located on the manifold—they are conveniently located in the jumper flowline envelope and can be recovered with minimal disruption to the flow system. As such, active flow components located within the modules are also easily removable and recoverable. It is therefore beneficial to provide certain flow components within the modules, instead of providing them within the ILT or PLET itself, as removal and retrieval of a module alone is simpler, cheaper and less disruptive than retrieval of the entire PLET or ILT if repair or replacement of the flow components is required.

The selection as to whether to route production fluid through production flowline A or flowline B may be influenced by factors such as the pressure and/or flow rate of production fluid from the subsea well and the pressure and/or flow rate of fluid in the production flowline.

The interfaces 634 and 636 and are triple-bore interfaces, providing triple bore access for: receiving production fluid from a well, routing production fluid to a first production flowline and/or routing production fluid to a second production flowline.

Alternatively configured flow systems are shown in FIGS. 8A to 8E. These embodiments illustrate the adaptability of the principles of the invention to include different levels of flow isolation, which can be required by certain projects, operators and/or in certain operating regions. These Figures also demonstrate flexibility with respect to the provision and placement of flow components.

Figure 8A:
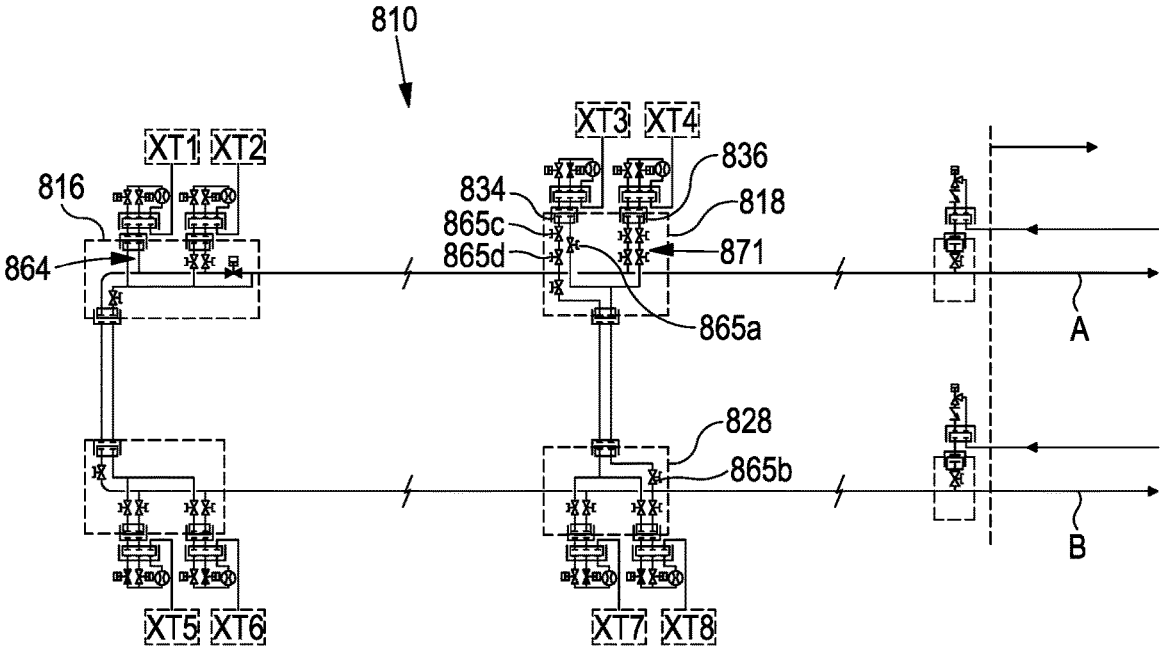
FIGS. 8A to 8E are schematic piping and instrumentation diagrams of alternatively configured subsea systems according to embodiments of the invention.

FIG. 8A shows a flow system 810 which is similar to the flow system 610 of FIG. 7 and functions in substantially the same manner as the flow system 610, with like features indicated by like reference numerals, incremented by 200. Like the system 610, the system 810 allows production fluid flowing from a subsea well to be routed into either of production flowlines A or B.

The system 810 differs from the system 610 in several ways. In particular, the system 810 offers different levels of flow isolation. For example, the pair of flow bores shown generally at 864 in the PLET 816 which are associated with Christmas tree XT1 are not provided with any valves to isolate the bores 864. Isolation is provided by a removable module (such as a flow access hub and/or a functional module) or by a flow cap (not shown) when no well is connected to the flow access interface. By removing the isolation valves from the PLET in this way, and providing them elsewhere in the flow system, the PLET can be made smaller and lighter. This is beneficial when pipeline and equipment size and weight constraints apply to the flow system, for example, size and weight constraints of the pipelay installation equipment.

Another way in which the flow system 810 differs from that 610 of FIG. 7 is that the ILT 818 is provided with additional flow isolation valves for both of its flow access interfaces 834, 836, which are located in the associated flow bores to provide double isolation between the headers A and B and the interfaces 834 and 836. For example, the production flowline header A can be isolated from the flow access interface 834 using the arrangement of valves 865*c* and 865*d* and the production flowline header B can be isolated from the flow access interface 834 using the arrangement of valves 865*a* and 865*b*. Double isolation, multiple isolation levels greater than two, and/or a combination of isolation levels, can be provided for one or more of the bores forming flow access interfaces in alternatively arranged flow systems by providing isolation valves in removable modules (including flow access hubs and removable functional modules), in one or more of the flow bores of the manifold (such as the ILT 818 or other manifold type) and/or in an associated, fluidly connected manifold (such as the ILT 828 or other manifold).

To tie in a well—for example, the well associated with subsea tree XT4—in a system without isolation, the well of XT3 would typically be shut in and the production flowline header A would be depressurised. This process is costly and time consuming as it halts production from other wells connected to the flow system. However, the arrangement shown in FIG. 8A negates this requirement. Instead, the four valves shown generally at 871 in the ILT 818 can be closed until the tree XT4 is fluidly connected to the flow system without impacting production from any of the other subsea wells connected to the flow system 810.

Although not shown, it will also be appreciated that ROV hot stabs may be provided in any of the manifolds, flow access hubs and/or removable functional modules for facilitating the performance of seal assurance testing of the seals between these components.

Figure 8B:
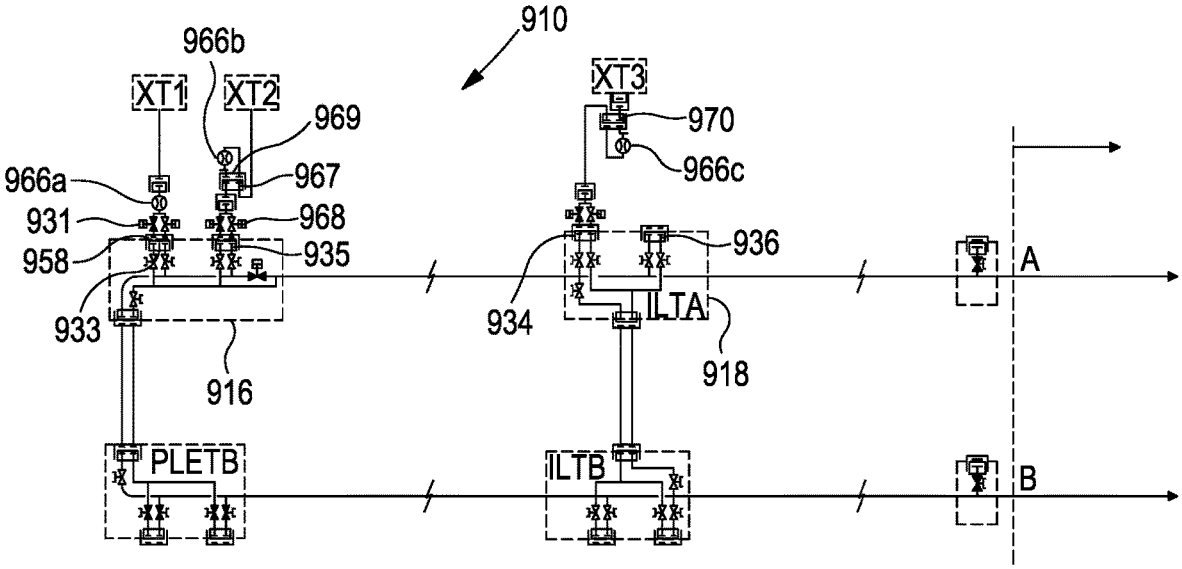

FIG. 8B shows an alternative flow system 910. In this arrangement, single isolation is provided between each of the flow access interfaces 933, 935, 934 and 936 and the production flowline headers A and B. FIG. 8B demonstrates the flexibility allowed by embodiments of the invention, specifically relating to the provision of flow components, such as flow meters 966*a*, 966*b* and 966*c*.

The removable functional module 931 installed on the flow access hub 958 on the flow access interface 933 of PLET 916 comprises a lower dual bore interface for fluidly coupling to the dual bore interface of the hub 958 and an upper single bore interface. The removable module 931 receives fluid from a subsea Christmas tree XT1 via the single bore interface and routes the production fluid through a flow meter 966*a* provided in fluid communication with the single bore interface, before selectively splitting the flow using valves provided in the module 931 in combination with valves in the PLET 916 to route it into either, or both, of production headers A and B.

The flow meter 966*b* has an alternative placement. In this arrangement, the removable module 968 similarly comprises a lower dual bore interface for fluidly coupling to the dual bore interface of the hub on flow access interface 935 and an upper single bore interface. However, this removable module does not contain a flow meter. Instead, a further flow access hub 967 is provided on the upper single bore interface of the removable module 968 between the subsea tree XT2 and the removable module 968, providing a dual bore access interface 969. A flow meter module comprising flow meter 966*b* is fluidly connected to the interface 969 for metering fluid flow from the tree XT2. This configuration is advantageous because the flow meter 966*b* can be retrieved to the surface—for example, for repair or replacement or to be swapped out completely for a different flow component—without disturbing any of the wider flow system, including the connection between the subsea tree XT2 and the flow system via the flow access hub 967. In contrast, to retrieve the flow meter 966*a* associate with the production from Christmas tree XT1 the entire removable module 931 must be recovered. This operation would be more complex, requiring disconnection from the tree XT1 as well as the hub 958.

Like the flow meter 966*b*, the flow meter 966*c* can also be recovered individually without disturbing the wider flow system. In this arrangement, the flow meter 966*c* is provided in a flow meter module coupled to a flow access hub 970 provided on an external flowline connector of the tree XT3.

It will be appreciated that in any of the foregoing embodiments, if and where flow access hubs are provided, the flow access hubs can comprise any number of bores and define single or multi-bore interfaces depending upon the layout and requirements of the flow system. The hubs can be provided with valves and/or additional components, where required. Likewise, removable functional modules can define one or more flow access interfaces which may be single or multi-bore interfaces, or a combination of the two, and may comprise isolation valves or other flow components, equipment, instrumentation or access points as required.

Figure 8C:
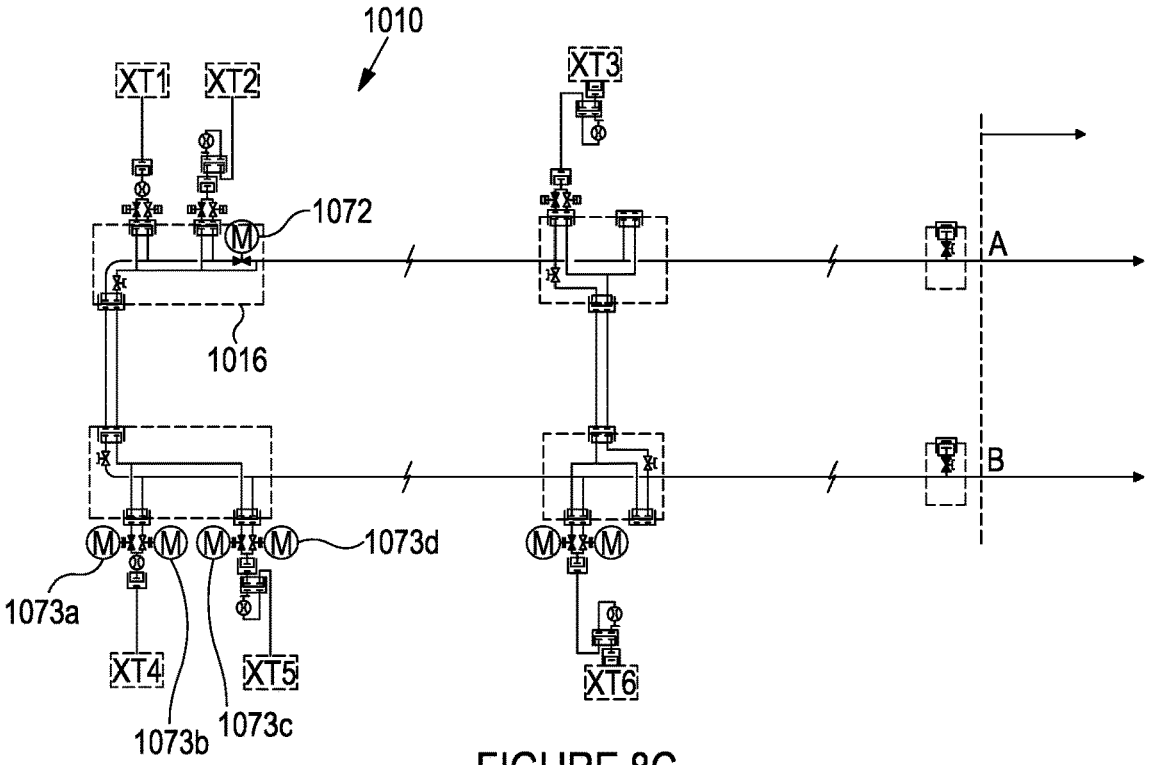

In FIG. 8C, a level of isolation has been removed by removing a number of the valves from the PLET 1016 (i.e. when compared with the PLET 916 shown in FIG. 2B). The PLET 1016 has been further simplified by providing an electrically actuated valve 1072 instead of a hydraulically actuated valve. By doing so, hydraulic supply components and connections can be removed from the PLET 1016. Replacing hydraulic valves with electrically actuated valves in this manner can be performed throughout the distributed manifold flow system 1010, if desired. For example, electrically actuated valves 1073*a*, 1073*b*, 1073*c* and 1073*d* can be provided in place of hydraulic valves.

Figure 8D:
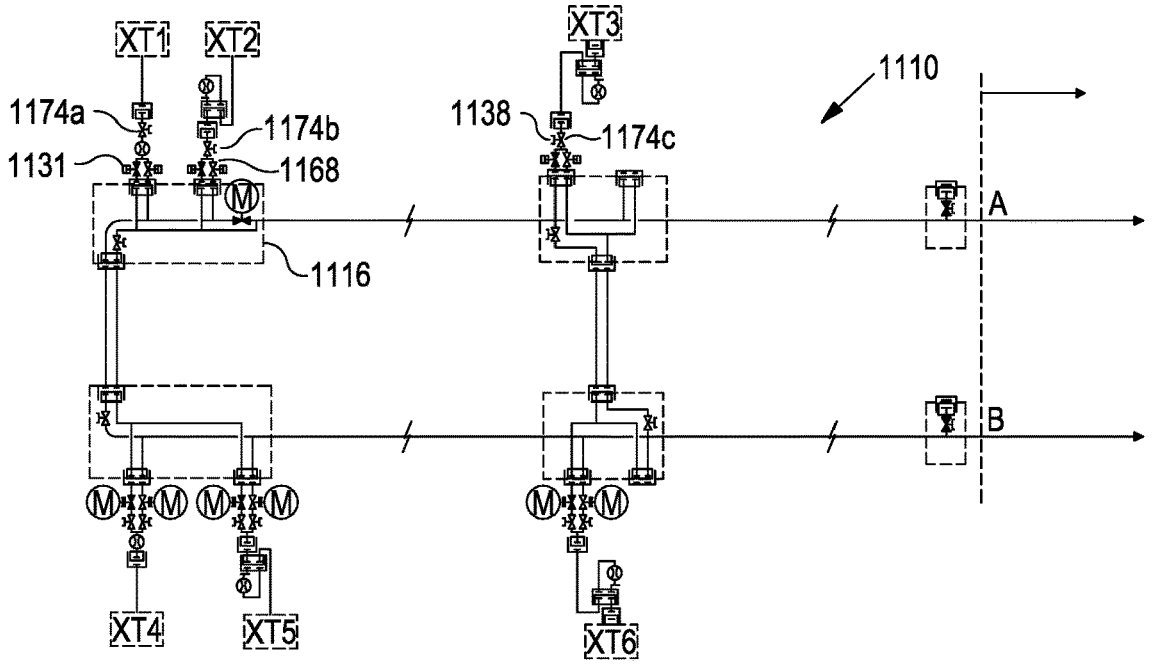

Like the foregoing embodiments, the flow system of FIG. 8D utilises removable modules 1131, 1168 and 1138 which each define a lower dual bore interface for fluidly coupling to the dual bore interface of flow access hubs 958, for connecting them to the PLET and ILT. Production fluid from the wells associated with trees XT1, XT2 and XT3 flow into a single bore interface and through a single flowline of the modules 1131, 1168 and 1138, respectively, before being selectively split in two. By providing an isolation valve 1174*a*, 1174*b* and 1174*c* in the single flowline section of the modules 1131, 1168 and 1138, respectively, double isolation can be achieved for each of the flow bores in each module, by using three valves instead of the usual four. Reducing the number of valves required to provide double isolation has beneficial cost, weight and space saving implications, which will appeal to some operators, particularly when operating within strict project constraints. Again, in any of the configurations shown an electrically actuated valve can be provided in place of a manual or a hydraulic valve, or vice versa.

Figure 8E:
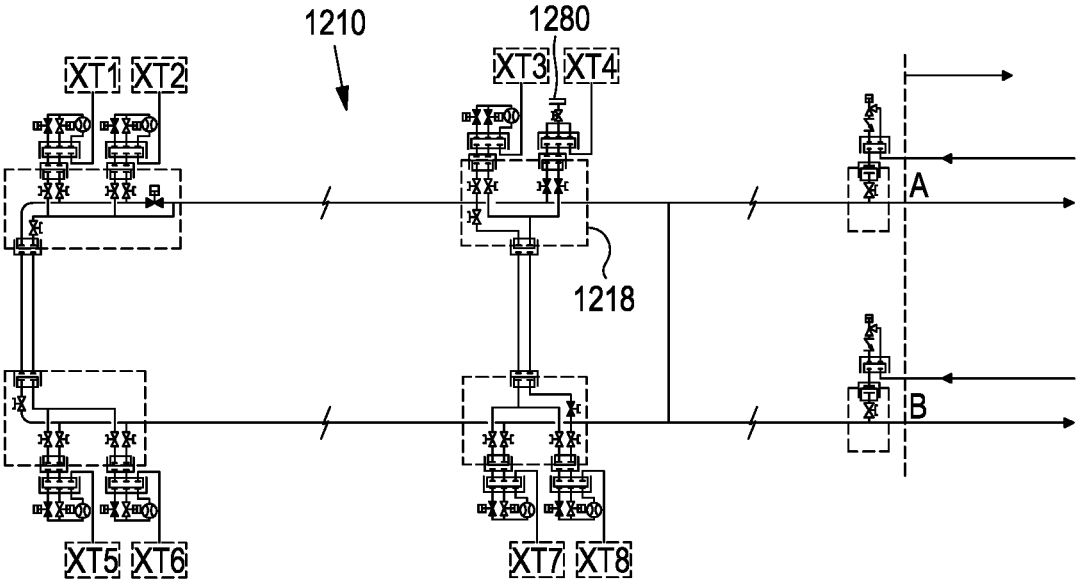

FIG. 8E shows a flow system 1210 having an ROV test pressure cap 1280 installed on a flow access interface of the ILT 1218 via a flow access hub. Before production from the well via Christmas tree XT4 commences, ROV test pressure cap 1280 allows for seal assurance testing of the seal between the flow system components—known as a backseat test—to be conducted. The module 1280 can be removed and replaced with an alternative or preferred removable module following completion of the test to facilitate production.

Figure 9A:
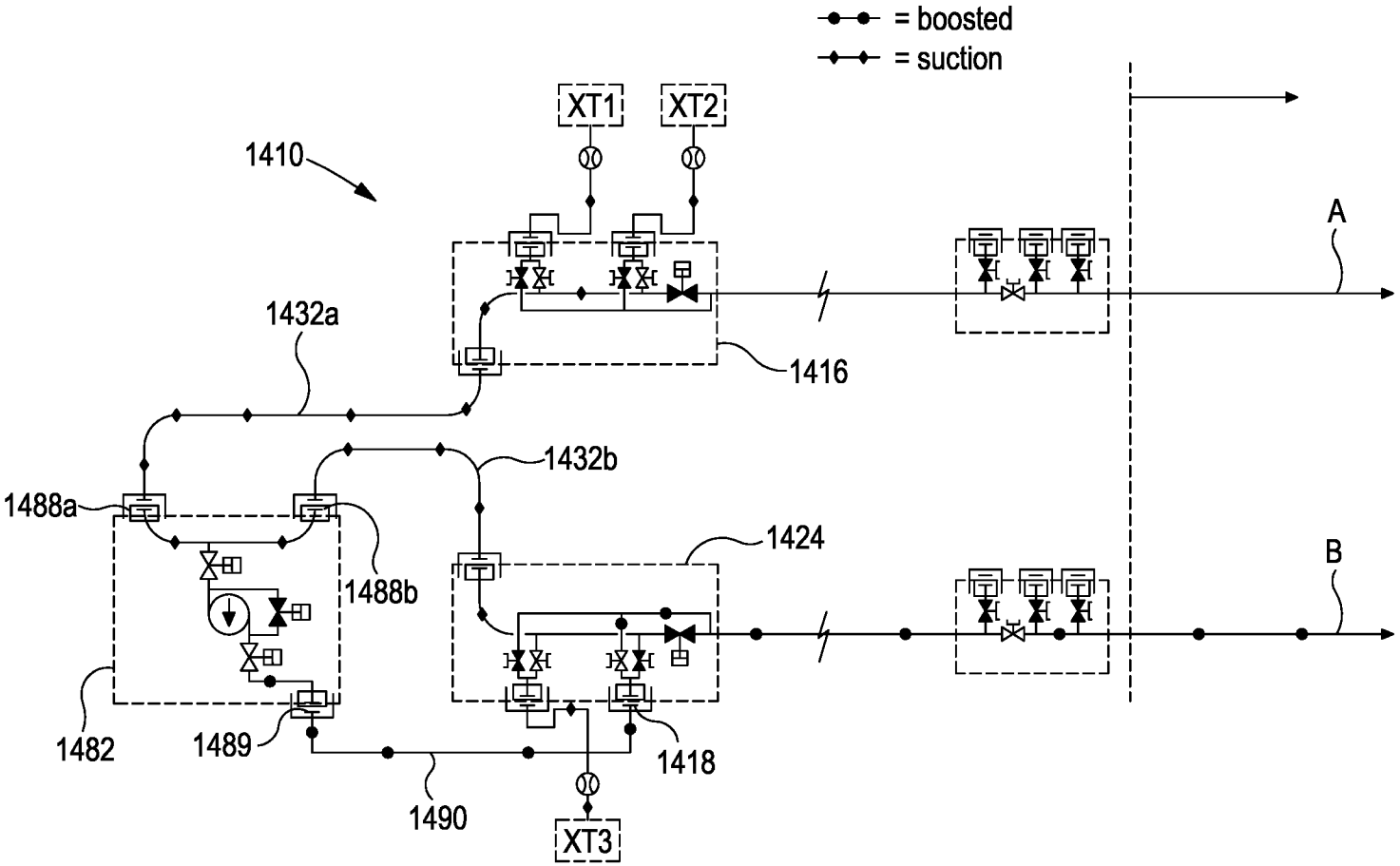
FIGS. 9A to 9C are schematic piping and instrumentation diagrams of alternatively configured subsea systems according to embodiments of the invention.
Figure 9B:
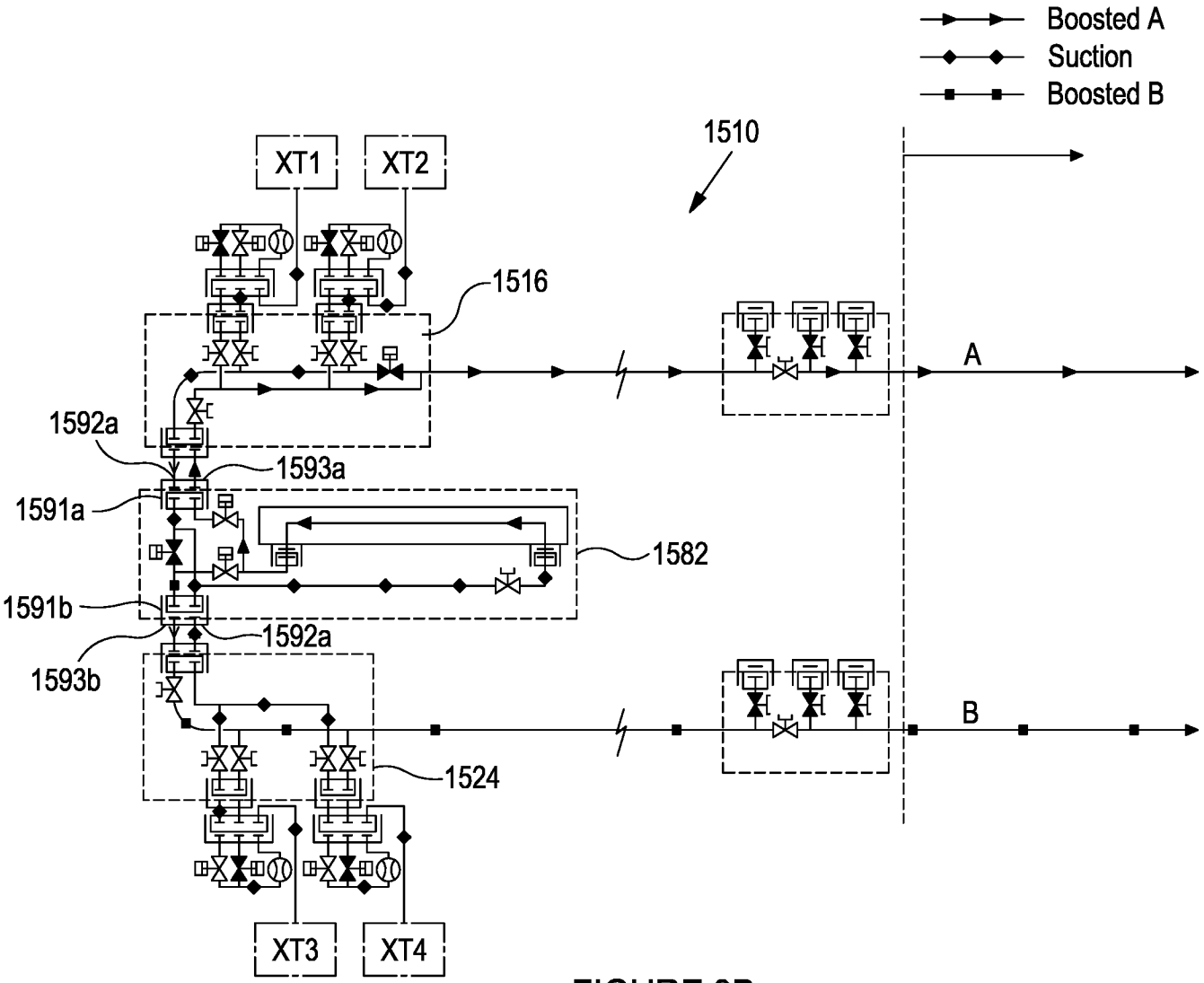
Figure 9C:
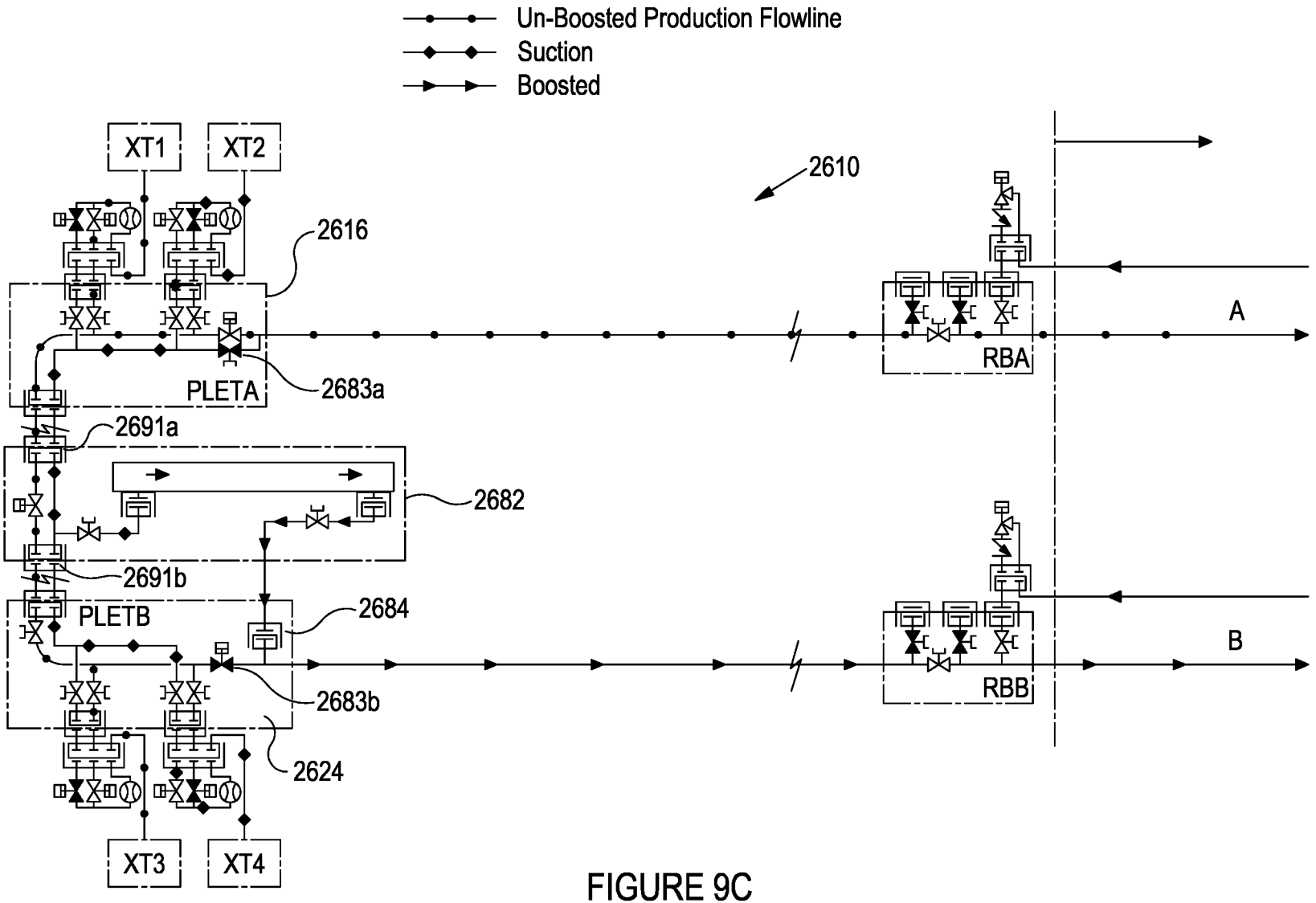

Embodiments of the invention can also be used to support flow boosting configurations, such as those shown in FIGS. 9A, 9B and 9C.

FIG. 9A shows a pumping arrangement 1410, in which each of the flowline headers A and B are production flowline headers. This arrangement is similar to that of the flow system 110 of FIGS. 2A and 2B. However, instead of being connected by a single flowline, the PLETS 1416 and 1424 are connected by two flexible jumper flowlines 1432*a* and 1432*b* provided on either side of a pumping module 1482. The flexible jumper flowlines 1432*a* and 1432*b* are connected to flowline connectors 1488*a* and 1488*b* on the module 1482.

By operating valves within the flow system to selectively route production fluid, the pumping module 1482 is operable to receive production fluid flowing from Christmas trees XT1, XT2 and/or XT3 via the PLETS 1416 and 1424 and jumper flowlines 1432*a* and 1432*a*, which each form inlet flowlines to the pumping module 1482. The pumping module boosts the flow rate of the production flow from trees XT1, XT2 and/or XT3 and discharges the boosted flow via an outlet flowline connector 1489 which is connected to a flow access interface 1418 of the PLET 1424 by a flexible jumper flowline 1490. The boosted production flow is therefore recovered to the surface via production flowline header B. It will be appreciated that a similar arrangement could be employed to boost flow in production flowline header A.

An alternative pumping arrangement is shown in FIG. 9B as 1510. Here, the flow system functions in a manner which is similar to the flow systems 610, 810, 910, 1010 and 1110 of FIGS. 7 and 8A to 8D, and will be generally understood with reference to the description accompanying those drawings. In this embodiment, the pumping module 1582 has two dual bore interfaces 1591*a* and 1591*b*, each interface having inlet bores 1592*a* and 1592*b* for receiving production fluid from respective subsea trees, and export bores 1593*a* and 1593*b* for discharging the boosted production fluid to production flowline headers A or B respectively. The system 1510 enables boosted production in flowline A, flowline B, or both of flowlines A and B simultaneously (for example to benefit from a 50% reduction in back pressure compared with a single flowline).

In the configuration shown, the valves have been opened/closed to provide boosted flow from all four wells XT1 to XT4 through both flowlines simultaneously. However, by opening and closing the valves in different combinations, production from wells XT1 and XT2 could be boosted through flowline A while production is allowed to flow naturally (unboosted) from wells XT3 and XT4 through flowline B. Alternatively, the valves can be operated to allow production from wells XT1 and XT2 to flow naturally through flowline A while production is boosted from wells XT3 and XT4 through flowline B. The valves can also be operated to bypass the pumping module and allow production from any of the wells to flow naturally through flowline A or flowline B selectively.

FIG. 9C is a schematic P&ID of an alternatively configured subsea system, 2610. The system 2610 functions similarly to the flow system 1510 and will be generally understood with reference to the description accompanying FIG. 9B. Like the system 1510, system comprises a pumping module 2682 having two dual bore interfaces 2691*a* and 2691*b*. Interface 2691*a* is fluidly connected to manifold 2616, and interface 2691*b* is fluidly connected to manifold 2624. Flow paths connecting the interfaces 2691*a* and 2691*b* enable production fluid from the subsea trees to the pump inlet or to bypass the pumping module to flow to the other of the manifolds. The system 2610 includes additional flow routing and valves to enable fully selectable boosted production flow or natural (unboosted) flow from any of the connected wells to either of the production flowlines.

Manifold 2616 is similar to manifold 1516, but includes a second isolation valve 2683*a* located on the downstream side of the manifold between the branch lines to the trees and the production flowline A, to enable independent isolation of trees XT1 and XT2 from flowline A without preventing flow to the manifold 2624 from either tree.

Manifold 2624 is similar to manifold 1524, but includes a connector 2684 for an outlet from the pumping module 2682 on the downstream side of the manifold between the branch lines to the trees and the production flowline, enabling pumping of boosted production flow into production flowline B. Manifold 2624 also includes an isolation valve 2683*b* located on the downstream side of the manifold between the branch lines to the trees and the production flowline B, to enable isolation of trees XT3 and XT4 from flowline B without preventing flow to the manifold 2616 from either tree.

The system 2610 enables flow from any of the connected wells to a naturally flowing production flowline (flowline A) or a boosted production flowline (flowline B). In the configuration shown, the valves have been opened/closed to enable natural flow from wells XT1 and XT3 to flowline A, and boosted flow from wells XT2 and XT4 to flowline B via the pump module 2682. However, by opening and closing the valves in different combinations, production from any combination of the wells could be boosted through flowline B while production is allowed to flow naturally (unboosted) from the other wells. Alternatively, all the wells can be allowed to flow naturally through both or either flowline, or all the wells can be boosted through flowline B.

Another feature of system 2610 is that it enables double isolation of the production pipelines from the subsea tree interfaces utilising combinations of valves from the pair of manifolds 2616 and 2624, without relying on arrangements of double inline isolation valves that would increase bulk and weight of the system. This facilitates later tie-ins or other operations that would otherwise require depressurisation of the pipeline system.

Figure 10A:
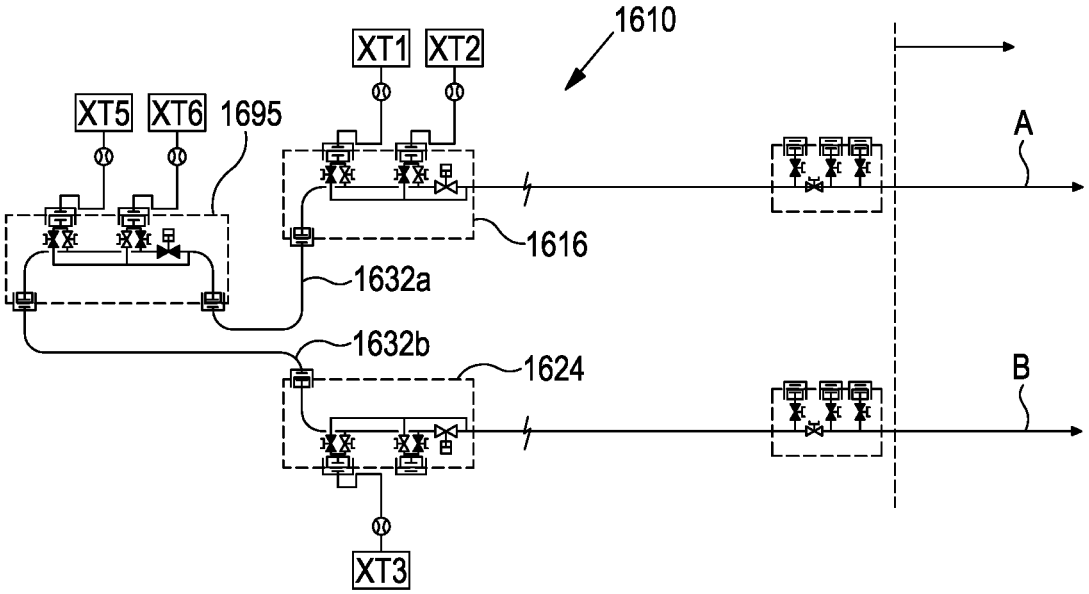
FIGS. 10A to 10C are schematic piping and instrumentation diagrams of alternatively configured subsea systems according to embodiments of the invention.
Figure 10B:
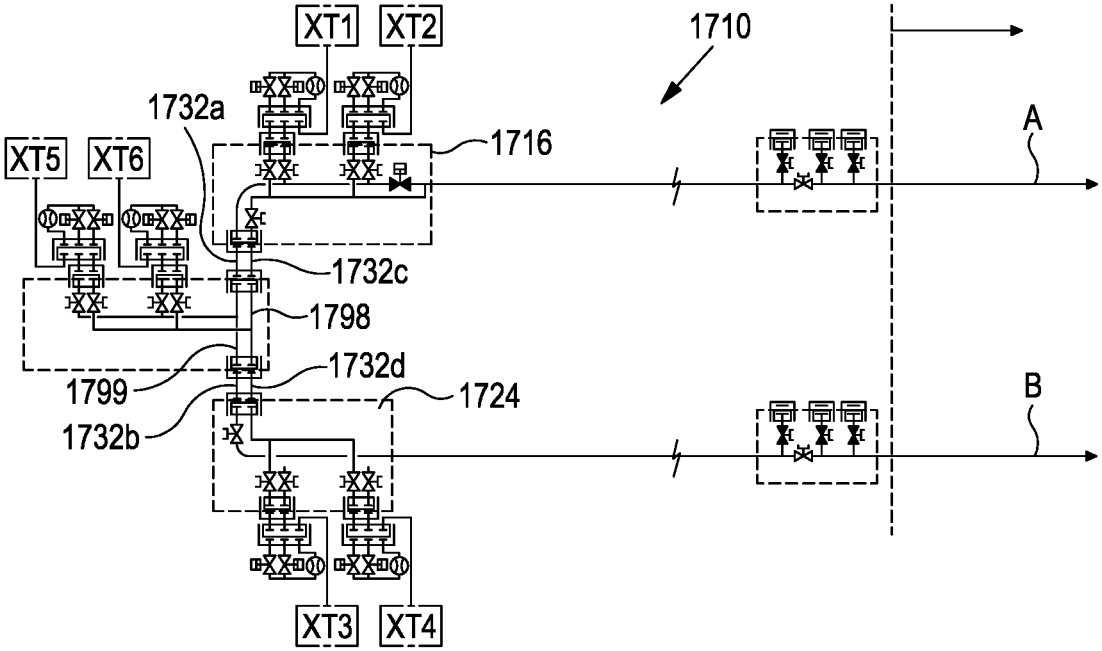
Figure 10C:
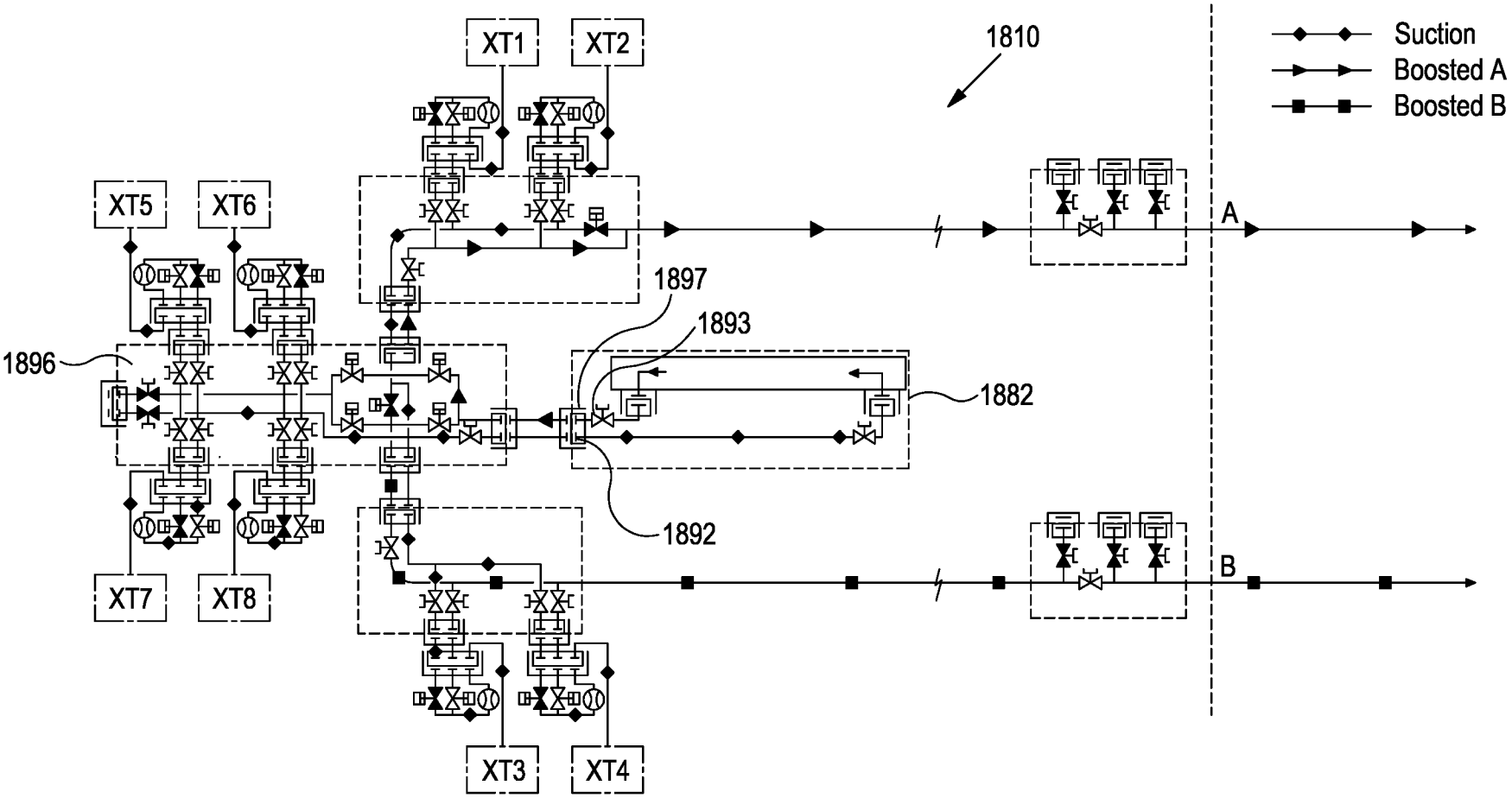

By providing flexible and adaptable subsea infrastructure solutions, embodiments of the invention support future subsea field expansion. As such, the system can be adapted to accommodate additional subsea wells in the future. FIGS. 10A, 10B and 10C show examples of subsea field expansion configurations.

FIG. 10A shows an expanded distributed manifold system generally at 1610. This arrangement is similar to that of the flow system 110 of FIGS. 2A and 2B. However, instead of being connected by a single flowline, the PLETS 1616 and 1624 are connected by two flexible jumper flowlines 1632*a* and 1632*b* provided on either side of an additional ILT 1695. As such, the flow system 1610 has been adapted to provide additional tie-in points for subsea Christmas trees XT5 and XT6. By providing further manifolds and further connecting flowlines, the principles of the invention can be employed to support further expansion of the subsea field.

FIG. 10B shows an expanded distributed manifold system 1710 which is similar to the flow system 610 of FIG. 7 and should be generally understood with reference to the description accompanying FIG. 7. The PLETS 1716 and 1724 are connected by two pairs of flexible jumper flowlines 1732*a*, 1732*b*, 1732*c* and 1732*d* provided on either side of a manifold 1796. The manifold comprises two main flowlines 1798 and 1799 which fluidly communicate with production header flowlines A and B, as well as connecting flowlines which fluidly couple a single bore of each dual bore interface to a respective main flowline, for selective production to flowline headers A and/or B in the same manner as described with reference to FIG. 7. As such, the flow system 1710 is adapted to provide additional tie-in points for subsea Christmas trees XT5 and XT6. By providing further manifolds and further connecting flowlines, the principles of the invention can be employed to support further expansion of subsea fields.

FIG. 10C is similar to the arrangement shown in FIG. 10B. However, the additional manifold 1896 comprises four flow access interfaces to accommodate the connection of four subsea wells: XT5, XT6, XT7 and XT8. In addition, a pumping module 1882 is provided, which comprises a single dual bore interface 1897 fluidly connected to a corresponding interface of the additional manifold 1896 via two flexible flowlines. The pumping module functions in a similar manner to the pumping modules 1582 and 2682 of FIGS. 9B and 9C, but differs in that it comprises a single dual bore interface 1897. The interface comprises an inlet bore 1892 for receiving production fluid from the subsea trees and an export bore 1893 for discharging the boosted production fluid to either of production flowline headers A or B.

Figure 11:
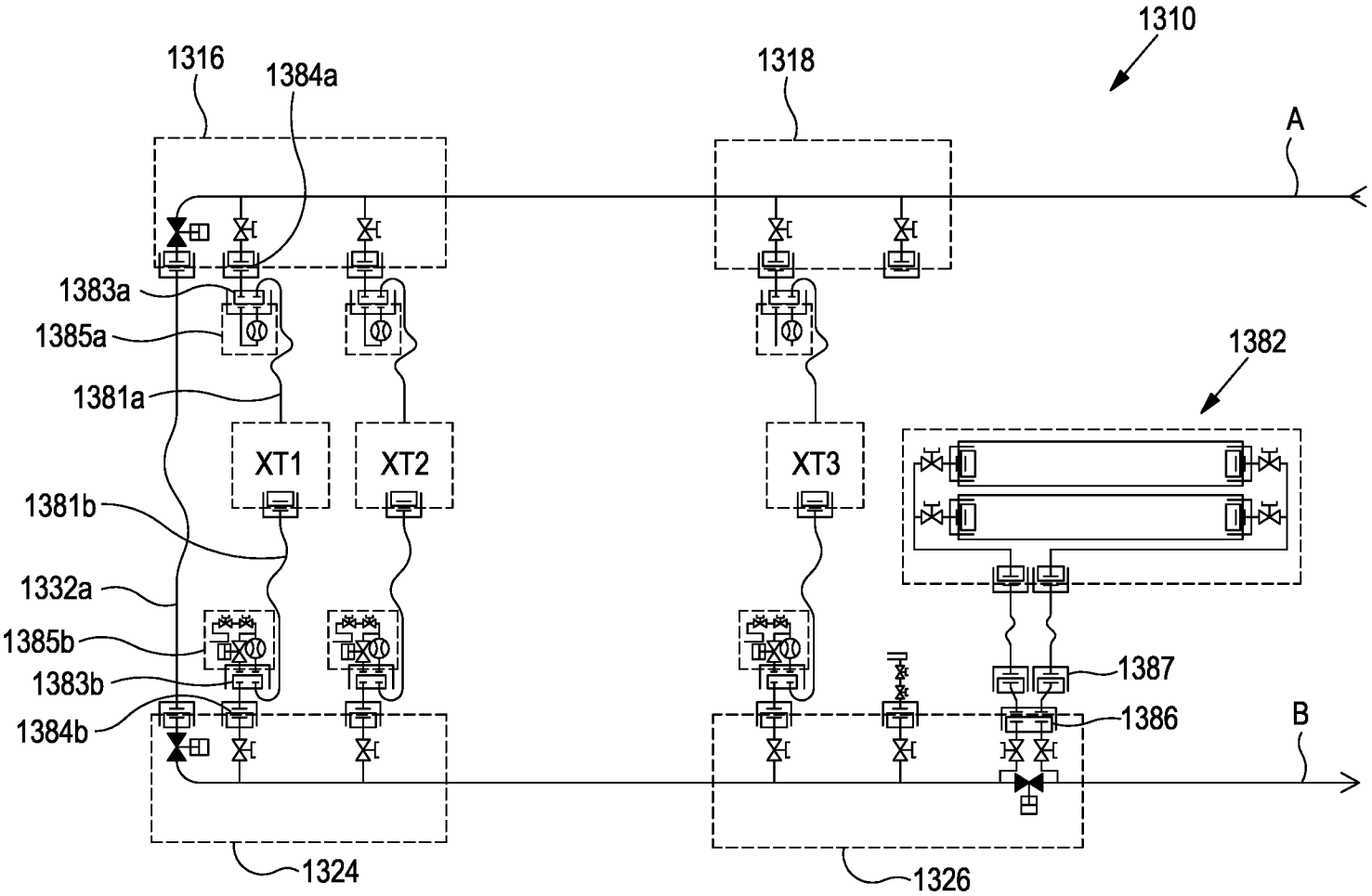
FIG. 11 is a piping and instrumentation diagram of a subsea system according to an embodiment of the invention, configured with a single production pipeline and a gas lift or service pipeline.

The foregoing embodiments relate to flow systems including two production pipelines, and configurations of spatially distributed manifolds and flow components which enable selective flow of production fluid from wells into the chosen pipelines. However, the principles of the invention extend to the connection of flow components and manifolds in flow systems that utilise a single production pipeline. An example is illustrated in FIG. 11, which shows a flow system 1310 including a single production pipeline B, and a second pipeline A in the form of a gas lift or service pipeline. The gas lift pipeline enables gas injection into the wells, and flowline header B is a production flowline header for exporting production flow from the wells to the surface.

In this configuration, subsea Christmas trees XT1 and XT2 are located between subsea PLETS 1316 and 1324. Each tree is connected to each respective PLET 1316 and 1324 by a flexible jumper flowline, a flow access hub and a removable functional module.

Taking XT1 as an example, the flowline 1381*a* couples XT1 to a flow access hub 1383*a* located on a flow access interface 1384*a* of PLET 1316 and the flowline 1381*b* couples XT1 to a flow access hub 1383*b* located on a flow access interface 1384*b* of PLET 1324. Removable functional modules 1385*a* and 1385*b* complete the fluid connection between the tree XT1 and the PLETs 1316 and 1324 which are integrated into flowline headers A and B, respectively. XT2 has a similar flow arrangement. XT3 is also similarly connected to the flow system 1310, but instead via ILTs 1318 and 1326. In use, the gas lift pipeline is able to feed gas from surface to each of the wells at XT1, XT2, and XT3 via the respective removable functional modules, which can control and meter the gas flow into the wells.

The gas lift injection lines, removable modules, or indeed the gas lift pipeline itself can be installed when needed to support the production from the wells in the system. In some fields, installation of one or more of the gas lift components may be later than the time of installation of the production flowline, which may initially produce without gas lift operations.

The ILT 1326 to which Christmas tree XT3 is coupled for production comprises an additional dual bore access interface 1386 which is not connected to a well. Instead, a pump module 1382 is connected to the access interface 1386 by a pair of flexible jumper flowlines and a flow access hub 1387. In use, the pump module 1382 can be used to boost the production flow rate of production header B. It will be appreciated that a pump module could also be provided in fluid communication with flowline header A, or in a second production header of a system comprising two production headers. More than one pump module can also be provided for additional boosting. Although the pump module is fluidly coupled to the header B via the ILT 1326, it will be appreciated that the module could be connected to the header B in alternative ways. For example, it could be directly connected to or integrated with the header and/or could be connected to a different manifold or manifold access point in communication with the flowline header. The pump module may be installed later than the time of installation of the production flowline, which may initially produce without pumping capability.

FIGS. 12A to 12D are respectively plan, exploded isometric, first exploded longitudinal sectional and second exploded longitudinal sectional views of an assembly according to a preferred embodiment of the invention. FIG.

Figure 12A:
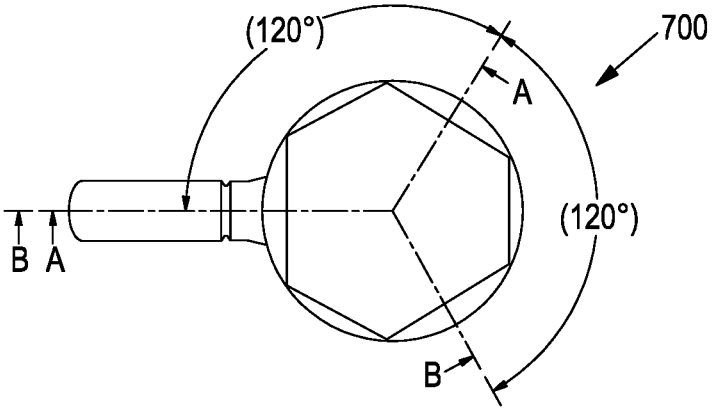
FIGS. 12A to 12D are respectively plan, exploded isometric, first exploded longitudinal sectional and second exploded longitudinal sectional views of an assembly according to a preferred embodiment of the invention.
Figure 12B:
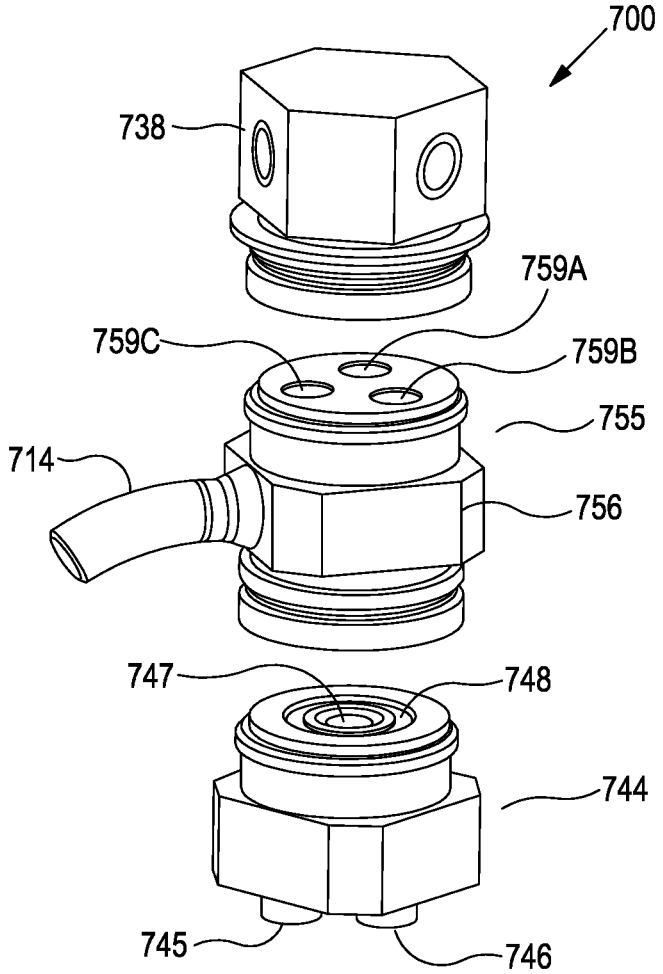
Figure 12C:
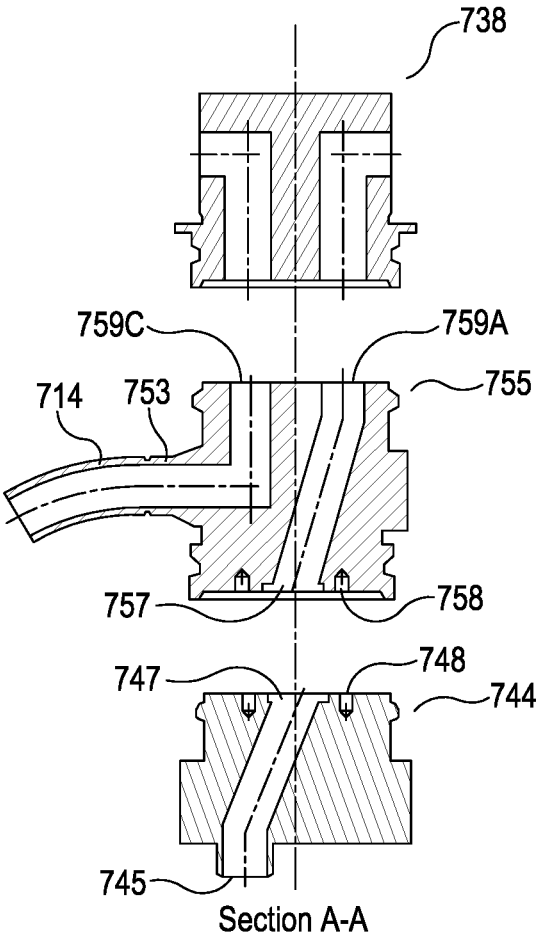
Figure 12D:
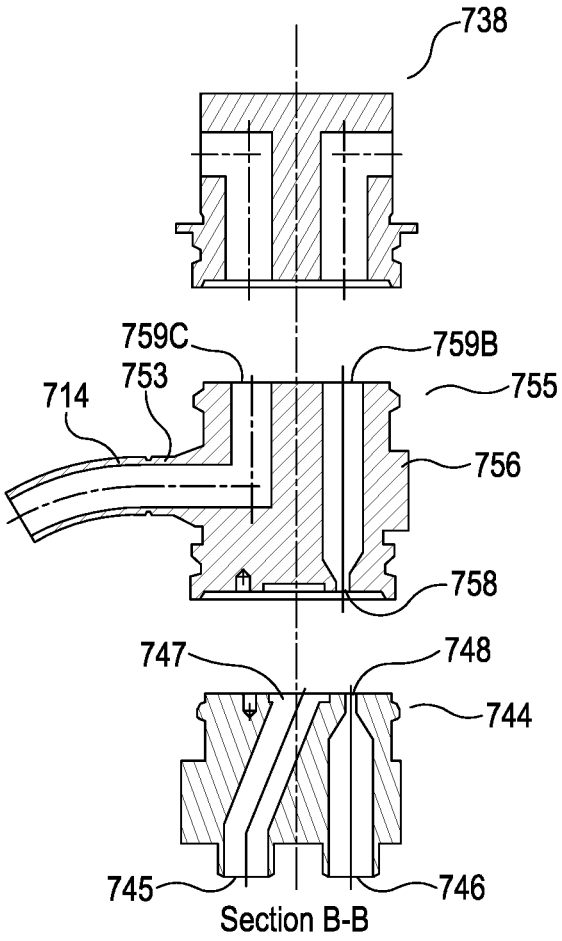

12C is a section through line A-A of FIG. 12A, and FIG. 12D is a section through line B-B of FIG. 12D. The assembly, generally shown at 700, comprises a connector hub 755, a manifold interface sub-assembly 744, and a module interface sub-assembly 738 of a removable module (the majority of the removable module is omitted for clarity, with only the lower interface sub-assembly 738 being shown).

The manifold interface sub-assembly 744 is fluidly connected to two flow bores 745, 746 of a manifold (not shown), which may be an ILT, PLET or alternative manifold, described with reference to FIGS. 2A to 7. In this embodiment, the interface sub-assembly 744 has a concentric dual bore interface, comprising a central bore 747 in communication with bore 745, and annulus bore 748 in communication with bore 746.

The connector hub 755 has a body 756, which has a lower dual bore interface in the same concentric configuration as the flowline connector 744, comprising a central bore 757 and an annulus bore 758. The bores 757 and 758 extend generally axially through the body 756 to respective openings 759A, 759B in a module interface at the upper end of the hub.

In addition, the hub 755 comprises a flowline connector bore 759 for connection to a jumper flowline 714, which typically functions as a fluid inlet for fluid from the jumper flowline 714, for example from a connected production well. The flowline connector bore 753 is substantially radially oriented with respect to the body 756 (whereas the bores 757, 758 are substantially axially oriented in the body). The jumper flowline 714 may be connected to the flowline connector bore by any suitable industry connector, but in preferred embodiments the jumper flowline 714 and the hub 755 are integrally formed so that the hub 755 is a part of the jumper system (or jumper envelope) and can be installed or retrieved with the jumper flowline itself.

The flowline connector bore 759 redirects within the body 756 to be in fluid communication with a third opening 759C on an upper module interface on the hub. The upper module interface therefore comprises three separated and parallel axial bores.

The removable module has a triple-bore lower interface 738 corresponding to the triple-bore upper interface of the hub 755.

The assembly and in particular the hub 755 enable a three-way connector incorporating a flowline inlet to be created on a dual bore interface. The assembly 700 has general application to the provision of a three-way connection on a manifold, but in addition is a preferred configuration of installations according to embodiments of the invention described herein. In particular, the assembly 700 can be used with Branch FAM modules described with reference to FIGS. 4A and 4B, as the hub 338. The openings 759A and 759B are configured to be coupled to the outlets of the flow control means of the module and connect the module to the first and second flow paths within the manifold (to the first and second production headers respectively). The flowline bore 753 receives production fluid from the production jumper flowline from a connected subsea well, and the production fluid flows through the hub to exit through the opening 759C to the module. In the module, the fluid flows through the flowmeter to the flow control means, where it is selectively flowed to one or other production header.

The parallel triple-bore connection between the hub 755 and the module 738 requires precise alignment and azimuthal orientation in order for the bores to be properly coupled, and therefore can only be made in one angular orientation. In contrast, the connection between the concentric bores of the hub 755 and the connector 744 can be made at any angular orientation without risking the pairing of incompatible flowlines. This allows for quicker and easier installation of the parts, and a range of possible azimuthal departure angles for the jumper flowline 714. The assembly may be used with flexible jumper flowlines or rigid jumper flowlines depending on system requirements. The flexibility of the azimuthal departure angles for the jumper flowline 714 means that the assembly is particularly suited for use with M-shaped rigid jumper flowlines.

In alternative embodiments, for example where the installation is not sensitive to departure angles, the manifold interface and the lower interface on the hub may be of a non-concentric dual bore configuration. Configurations in which the dual bore manifold interface for the hub is integrated into the manifold, as well as configurations in which the dual bore interface is formed on the manifold by the installation of a sub-assembly on the manifold, are within the scope of the invention. In a further alternative configuration, the triple bore interface of the hub is a triple concentric bore interface, rather than the parallel axial bore interface shown in FIG. 12B. The removable module would then have a concentric triple-bore lower interface corresponding to the concentric triple-bore upper interface of the hub, so that coupling of the module and the hub is not sensitive to precise alignment and azimuthal orientation.

FIGS. 13 to 16C show alternative assemblies to the concentric flow bore arrangement of FIGS. 12A to 12D, having hubs with parallel flow bore arrangements. In some concentric arrangements, a collapsing force can be created between the annulus bore and the central bore, due to the pressure differential between the bores. Where this is likely to happen, parallel bore arrangements may be preferred.

The assemblies function generally in the same way as that of FIGS. 12A to 12D and their operation will be understood with reference to FIGS. 12A to 12D and the accompanying description.

Figure 13:
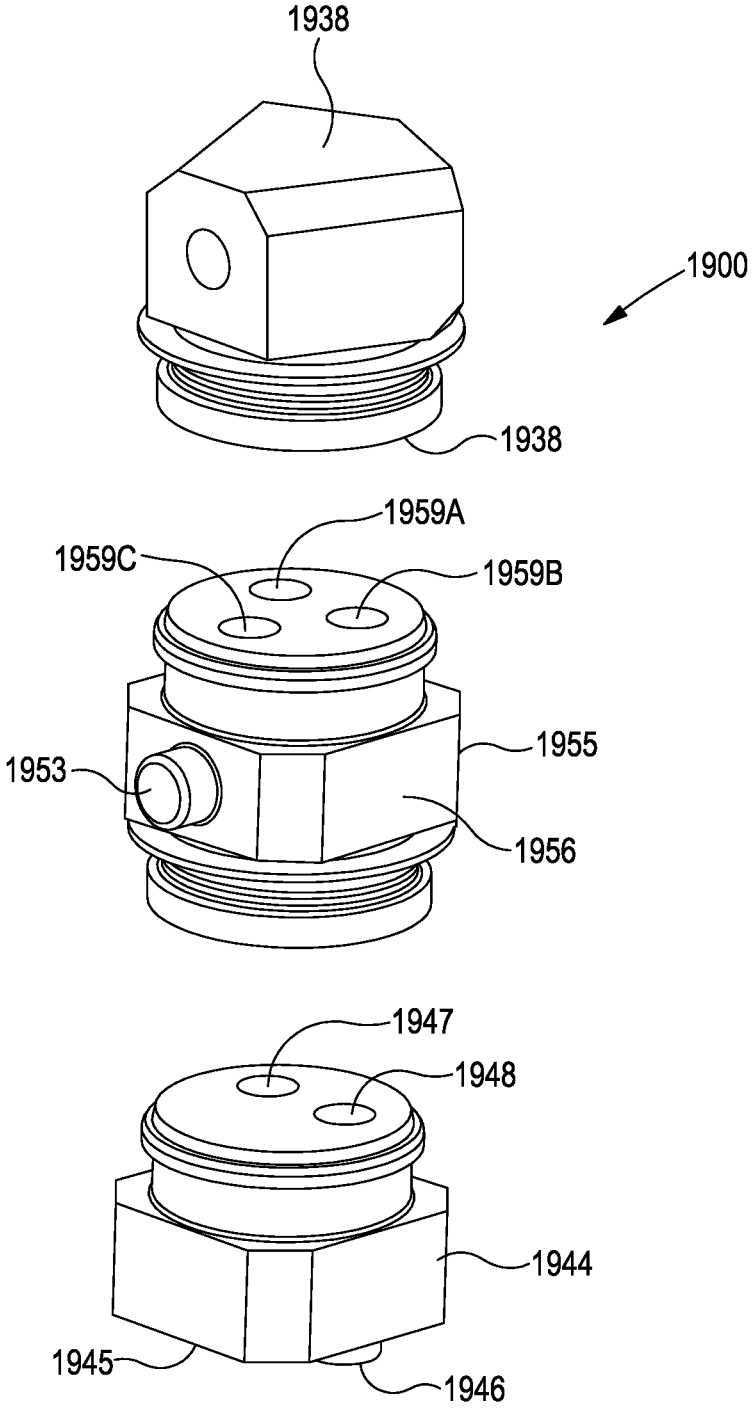
FIG. 13 is an exploded isometric view of an assembly according to an alternative embodiment of the invention.

The assembly of FIG. 13, generally shown at 1900, comprises a connector hub 1955, a manifold interface sub-assembly 1944, and a module interface sub-assembly 1938 of a removable module (the majority of the removable module is omitted for clarity, with only the lower interface sub-assembly 1938 being shown). The module interface sub-assembly 1938 comprises three upper bore openings and three lower bore openings, one corresponding to each of the bores 1959A, B and C of the connector hub 1955.

The manifold interface sub-assembly 1944 is fluidly connected to two flow bores 1945, 1946 of a manifold (not shown), which may be an ILT, PLET or alternative manifold, described with reference to FIGS. 2A to 7. In this embodiment, the interface sub-assembly 1944 has an off-centre parallel dual bore interface, comprising a first bore 1947 in communication with bore 1945, and a second bore 1948 in communication with bore 1946. The interface sub-assembly 1944 therefore acts as an adaptor. It shifts the axially symmetrical configuration of the flow bores 1945, 1946 of the manifold (not shown) to an off-centre parallel dual bore arrangement, to present an interface complimentary to the lower interface of the connector hub 1955 and thereby facilitate connection of the connector hub 1955 to the manifold (not shown).

The connector hub 1955 has a body 1956, which has a lower dual bore interface (not shown) in the same parallel configuration as the manifold interface sub-assembly 1944, comprising parallel bores. The bores extend generally axially through the body 1956 to respective parallel openings 1959A, 1959B in a module interface at the upper end of the hub.

In addition, the hub 1955 comprises a flowline connector bore 1953 for connection to a jumper flowline (not shown), which typically functions as a fluid inlet for fluid from the jumper flowline, for example from a connected production well. The flowline connector bore 1953 is substantially radially oriented with respect to the body 1956 (whereas the bores of the lower dual bore interface (not shown) of the hub 1955 are substantially axially oriented in the body). The jumper flowline may be connected to the flowline connector 1953 bore by any suitable industry connector. In arrangements of the invention the jumper flowline and the hub 1955 are integrally formed so that the hub 1955 is a part of the jumper system (or jumper envelope) and can be installed or retrieved with the jumper flowline itself.

The flowline connector bore 1953 redirects within the body 1956 to be in fluid communication with a third opening 1959C on an upper module interface on the hub 1955. The upper module interface therefore comprises three separated and parallel axial bores.

The removable module has a triple-bore lower interface 1938 corresponding to the triple-bore upper interface of the hub 1955.

The parallel triple-bore connection between the hub 1955 and the interface sub-assembly 1944 requires precise alignment and azimuthal orientation in order for the bores to be properly coupled, and therefore can only be made in one angular orientation. Therefore, in the assembly 1900 the azimuthal departure angle for the jumper flowline (not shown) is set by the location of the flowline connector bore 1953. The hub 1955 can be machined to orient the flowline connector bore 1953 in the required location.

Figure 14A:
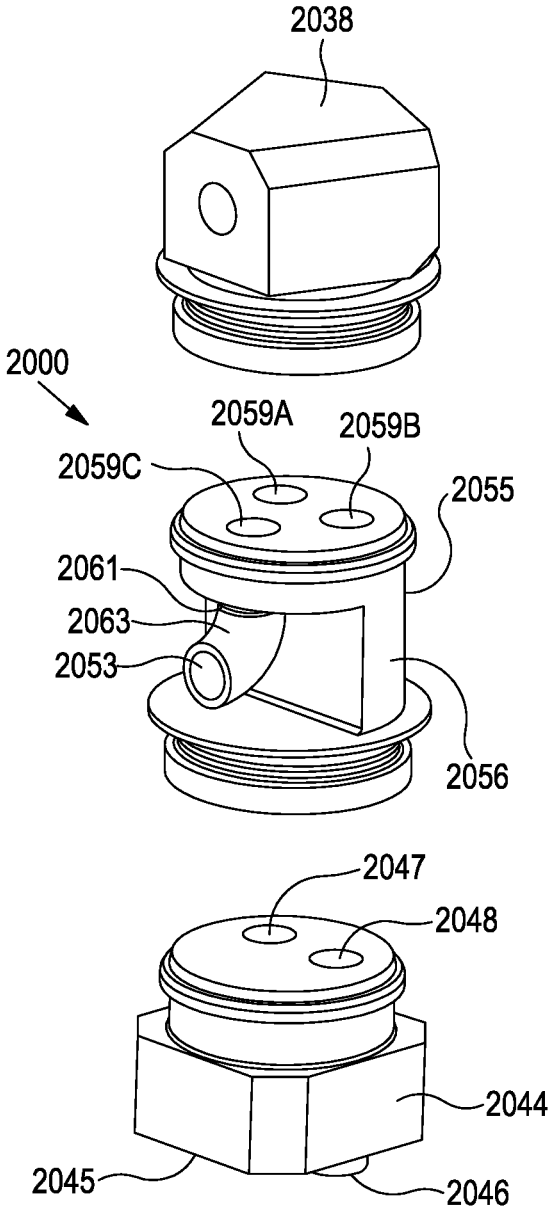
FIG. 14A is an exploded isometric view of an assembly according to an alternative embodiment of the invention.

The assembly of FIG. 14A is similar to that shown in FIG. 13 and will be understood with reference to the description accompanying FIG. 13, with like features indicated by like reference numerals incremented by 100. The assembly 2000 differs from the assembly 1900, in that it includes an alternatively configured flowline connector hub 2055 (shown in FIGS. 14A and 14B).

The connector hub 2055 has a body 2056, which has a lower dual bore interface (not shown) in the same parallel configuration presented by the manifold interface sub-assembly 2044, comprising parallel bores. The bores extend generally axially through the body 2056 to respective parallel openings 2059A, 2059B in a module interface at the upper end of the hub.

In addition, the hub 2055 comprises a flowline connector bore 2053 for connection to a jumper flowline (not shown). In the embodiment shown in FIGS. 14A and 14B, the body 2056 of the hub 2055 has been cut away, to accommodate an elbow piece 2063 which forms the flowline connector bore 2053. The elbow piece 2063 is fluidly coupled to a bore 2061 on a cut-away surface of the hub 2055 which is in fluid communication with the third opening 2059C on an upper module interface on the hub 2055.

The elbow piece 2063 is welded to the bore 2061 in a selected orientation to provide a flowline connector bore 2053 having a chosen azimuthal departure angle for the jumper flowline (not shown). The orientation of the flowline connector bore 2053 and thus the departure angle offered to a jumper flowline by the hub differs between FIGS. 14A and 14B, as the elbow piece 2063 is welded (i.e. fixed) in a different manner in each figure.

By providing a cut-away hub body 2056 in this way, the machining required to produce a hub 2055 having an optimum azimuthal departure angle for a jumper flowline is substantially reduced.

Figure 14B:
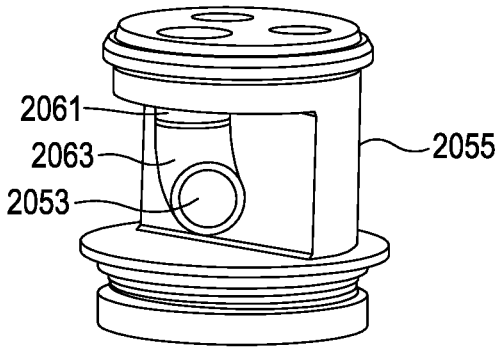
FIG. 14B is a perspective view of a hub of the assembly of FIG. 14A.
Figure 15A:
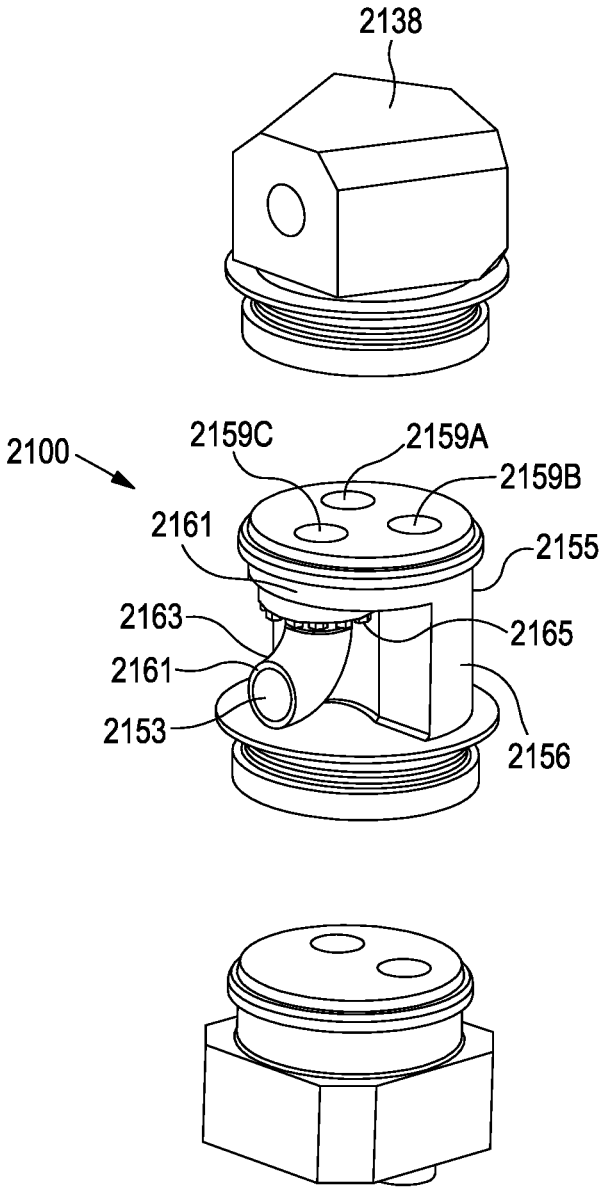
FIG. 15A is an exploded isometric view of an assembly according to an alternative embodiment of the invention.

The assembly of FIG. 15A is similar to that shown in FIGS. 14A and 14B and will be understood with reference to the description accompanying those figures, with like features indicated by like reference numerals incremented by 100. The assembly 2100 differs from the assembly 2000, in that it includes an alternatively configured flowline connector hub 2155 (shown in FIGS. 15A and 15B).

Instead of being welded to the hub, the flowline connector bore 2053 is formed by an elbow piece 2163 having an integral end flange 2165 comprising various apertures for receiving bolts. The elbow piece 2163 is fluidly coupled to a bore 2161 on a cut-away surface of the hub 2155 via the bolted flange 2165, the cut-away surface comprising complimentary apertures for receiving the bolts and coupling the elbow piece 2163 to the hub 2155.

By rotating the flange 2165 with respect to the bore 2161 and bolting it in place, the orientation of the elbow piece 2163 can be adjusted. Therefore, the elbow piece 2163 can be selectively coupled to the bore 2161 in to provide a flowline connector bore 2153 having a chosen azimuthal departure angle for the jumper flowline (not shown). As the elbow piece 2163 and the bolted flange 2165 are one, integral piece, the elbow piece 2163 will have a number of rotational positions depending upon the number of bolts on the flange 2165 and corresponding apertures in the cut-away surface of the hub 2155.

Figure 15B:
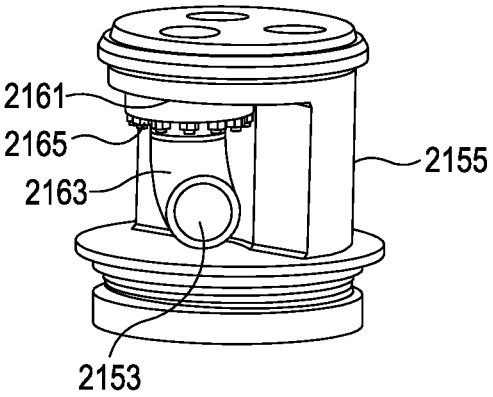
FIG. 15B is a perspective view of a hub of the assembly of FIG. 15A.

The orientation of the flowline connector bore 2153 and thus the departure angle offered to a jumper flowline by the hub differs between FIGS. 15A and 15B, as the elbow piece 2063 is bolted in a different manner in each figure.

By providing a flanged elbow piece in this way, the hub 2155 is adaptable. The azimuthal departure angle for a jumper flowline can be changed, in future, by adjusting the position of the flange 2165 with respect to the hub 2155.

It will be appreciated that alternative flanged arrangements could also be provided. For example, the elbow piece may be rotatably with respect to the flange, so that the radial position of the flowline connector bore 2153 can be indexed whilst the flange 2165 remains in place, fixed to the hub 2155.

Figure 16A:
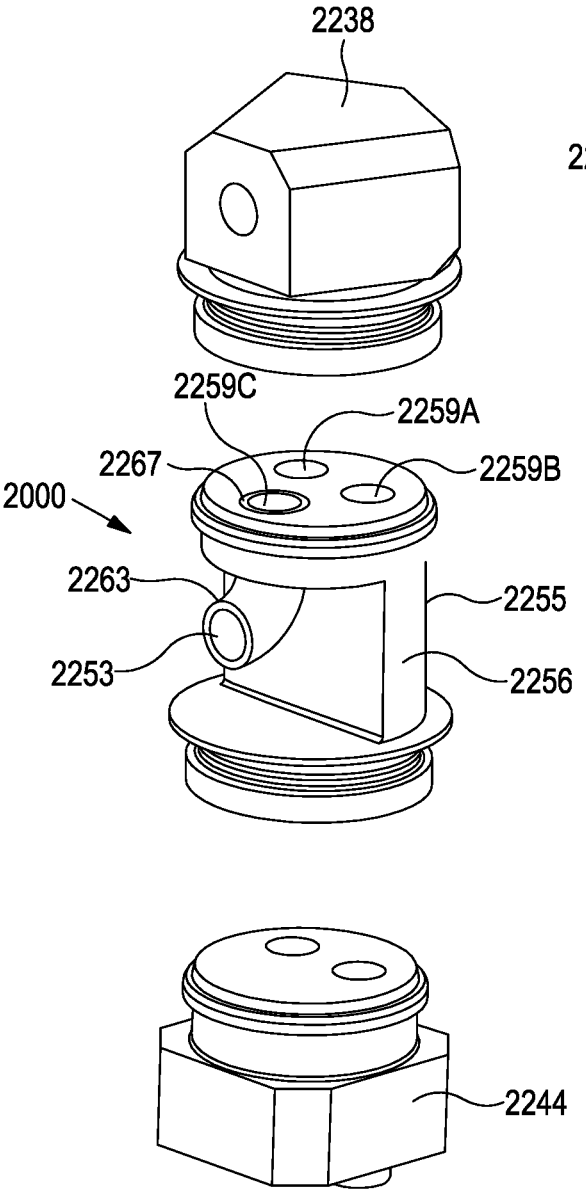
FIG. 16A is an exploded isometric view of an assembly according to an alternative embodiment of the invention.
Figure 16B:
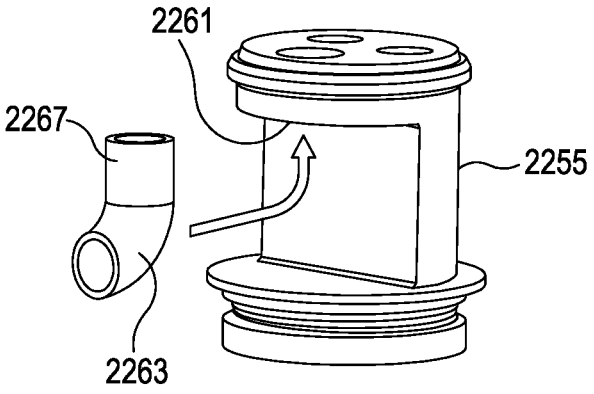
FIGS. 16B and 16C are perspective views of a hub of the assembly of FIG. 16A.
Figure 16C:
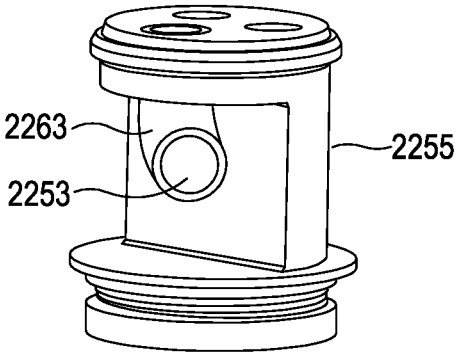

The assembly of FIG. 16A is similar to that shown in FIGS. 15A and 15B and will be understood with reference to the description accompanying those figures, with like features indicated by like reference numerals incremented by 100. The assembly 2200 differs from the assembly 2200, in that it includes an alternatively configured flowline connector hub 2255 (shown in FIGS. 16A and 16C).

Instead of being bolted to the hub by a flange, the flowline connector bore 2253 is formed by an elbow piece 2263 having a straight extension portion 2267. The elbow piece 2263 is a removable insert, the extension portion 2267 of which is inserted into the hub bore 2261 (as shown by the arrow in FIG. 16B) in any desired orientation to provide a flowline connector bore 2253 having a chosen azimuthal departure angle for a jumper flowline (not shown). The insert is fixed in place by in the hub, for example by a clip (such as a circlip) or a clamp. The elbow piece 2263 insert is freely rotatable with respect to the axis of the hub body 2256. This configuration is advantageous as the orientation of the elbow 2263 with respect to the hub 2255 and, as a result, the flowline connector bore 2153, is not restricted by the number and the position of bolts, like that of the elbow piece of FIGS. 15A and 15B. The assembly may comprise a fixing means to fix the insert in place, temporarily or permanently.

In the embodiments shown in FIGS. 14A to 16C, the elbow section may have a different shape, size or orientation. Likewise, the cut-out section of the hubs may be configured differently.

In the embodiments shown in FIGS. 12 to 16C, the manifold interface sub assembly may be omitted, and the connector hub may be connected directly to the bored of a manifold interface. Alternatively, the connector hub and the manifold interface sub assembly may be combined to as a single component. In further alternative configurations, the triple bore interfaces of the hub may be triple concentric bore interface, rather than the parallel axial bore interfaces shown. The removable modules would then have a concentric triple-bore lower interface corresponding to the concentric triple-bore upper interface of the hubs, so that coupling of the module and the hub is not sensitive to precise alignment and azimuthal orientation.

Although the terms upper and lower have been used to describe the configuration of fluid interfaces and connections throughout this specification, these are relative terms, and may be interchangeable with horizontal interfaces where a horizontal connection is made between components instead of a vertical connection.

Although the figures and the forgoing description describe fluid entering the distributed manifold system from a subsea Christmas tree, it will be appreciated that production fluid from alternative types of manifold (such as a well gathering manifold) or source may be routed into the distributed manifold system. For example, a well gathering manifold may comingle the production fluid from a number of subsea wells, which may then be routed into and through a manifold of the subsea distributed manifold system in the same manner as described above with reference to a subsea Christmas tree.

It will also be appreciated that, although one flow of production fluid is described as coming from each subsea well, additional and/or parallel flowlines may be provided which may carry, for example, gas to and from a well for gas lift operations.

It will be appreciated that although the distributed manifold systems described above are said to comprise ILTs and PLETs, they may instead (or also) comprise alternative types of manifold.

It will also be appreciated that the various manifolds and removable modules described throughout can be adapted to have vertical and/or horizontal connection points depending on system requirements.

The distributed manifold system functions in a similar way to that of a conventional twin header manifold. However, due to the nature of the distributed manifold system—which is made up of various manifolds (such as ILTs and PLETs) displaced from one another and connected by jumper flowlines, as opposed to a single, rigid manifold structure—the subsea field development has increased flexibility. A conventional twin header manifold sets fixed connection points for subsea wells on the manifold structure, whereas the distributed manifold configuration of the present invention allows manifolds to be placed at optimal positions on the seabed, to suit field development and reservoir geometry. This also allows for flexibility in top hole locations and, in some cases, negates the need for side-tracked wells.

Where future field development is expected, a large conventional manifold with surplus well connection points might be provided to accommodate any additional wells that are developed in the future. This will require large capital expenditure. In addition, conventional and/or modified manifolds for this use tend to have long lead times and require specialist vessels to deploy and install.

In contrast, the distributed manifold system of the present invention can be retrofitted into an existing subsea system to facilitate production from additional wells. The system can be provided to suit current field needs and further extended with the addition of smaller manifolds and flowlines when and if it becomes necessary to connect further subsea wells to the system. As the manifolds used in the distributed system are more compact and more readily available (as use can be made of standard components), lead times and capital expenditure are reduced.

Conventional manifolds for the connection of multiple wells require foundation piles to provide the necessary support. Such manifolds also have specific installation requirements which might include the use of specialist vessels. The flow components which form the distributed manifold are, in contrast, smaller and lighter; requiring less seabed support and removing the need for specialist installation vessels.

The comparatively compact nature of the manifolds utilised by the distributed manifold system of the present invention, along with the provision of additional instrumentation, valving and equipment in removable modules, makes the system easier to deploy and install. The manifolds are small and light enough to be integrated into the production pipeline and handled by the pipelay mechanisms on a conventional pipelay vessel. The removable modules can also be deployed and fitted using smaller vessels such as remotely operated vehicles (ROVs) at a later date (if not initially required).

It will be appreciated that variations to flow routing, valve configuration and placement, and combinations of features and functions from different described embodiments are within the scope of invention, and additional pressure test valves and chemical injection points may be incorporated into the systems at various locations to facilitate testing and flow assurance operations.

The invention provides a subsea oil and gas production installation, methods of installing the installation and methods of use. The installation comprises a subsea production system comprising a first production pipeline and a second production pipeline, a first subsea manifold in fluid communication with the first production pipeline comprising a fluid access interface and a flowline connector, a removable module fluidly connected to the fluid access interface of the first subsea manifold and configured to receive production fluid from one or more subsea wells and a second subsea manifold in fluid communication with the second production pipeline. The first subsea manifold defines a first flow path between the fluid access interface and the first production pipeline and a second bypass flow path between the fluid access interface and the flowline connector. The first and the second subsea manifolds are fluidly coupled to one another by a connecting flowline which is connected at a first end to the flowline connector of the first subsea manifold. The removable module comprises a flow control means operable to selectively route the production fluid from one or more subsea wells into the first production pipeline via the first flow path defined by the manifold, and/or into the second production pipeline via the second bypass flow path, the connecting flowline and the second subsea manifold.

Various modifications to the above-described embodiments may be made within the scope of the invention, and the invention extends to combinations of features other than those expressly claimed herein.

The invention claimed is:

1. A subsea oil and gas production installation, the installation comprising:

a subsea production system comprising a first production pipeline and a second production pipeline;

a first subsea manifold in fluid communication with the first production pipeline comprising a fluid access interface and a flowline connector;

a removable module fluidly connected to the fluid access interface of the first subsea manifold and configured to receive production fluid from one or more subsea wells; and a second subsea manifold in fluid communication with the second production pipeline;

wherein the first subsea manifold defines a first flow path between the fluid access interface and the first production pipeline and a second bypass flow path between the fluid access interface and the flowline connector;

wherein the first and the second subsea manifolds are fluidly coupled to one another by a connecting flowline connected at a first end to the flowline connector of the first subsea manifold; and wherein the removable module comprises a flow control means operable to selectively route the production fluid from one or more subsea wells into the first production pipeline via the first flow path defined by the manifold, and/or into the second production pipeline via the second bypass flow path, the connecting flowline and the second subsea manifold.

2. The installation according to claim 1, wherein the connecting flowline is a jumper flowline.

3. The installation according to claim 1, wherein the connecting flowline is connected at a second end to a flowline connector of the second subsea manifold.

4. The installation according to claim 1, wherein the connecting flowline is connected at a second end to a second removable module fluidly connected to a fluid access interface of the second subsea manifold.

5. The installation according to claim 1, further comprising a flow access hub, the flow access hub comprising a first interface connected to the fluid access interface of the first subsea manifold, and a second interface connected to an interface of a functional module wherein at least the functional module is removable from the first manifold.

6. The installation according to claim 5, wherein the interface of the functional module is a multibore interface in a single connector.

7. The installation according to claim 6, wherein first interface of the flow access hub has a lesser number of bores than the second interface of the flow access hub.

8. The installation according to claim 5, wherein the flow access hub defines a first flow path between a flowline inlet bore and the second interface to fluidly connect a flowline configured to carry fluid from a subsea well to the functional module, and defines a second flow path between the second interface and the first interface to fluidly connect the functional module to the first subsea manifold.

9. The installation according to claim 1, wherein the second subsea manifold comprises a flowline connector, and a second end of the connecting flowline is connected to the flowline connector.

10. The installation according to claim 1, wherein the second subsea manifold comprises a fluid access interface, and the installation comprises a removable module fluidly connected to the fluid access interface of the second subsea manifold.

11. The installation according to claim 10, further comprising a flow access hub comprising a first interface connected to the fluid access interface of the second subsea manifold, and a second interface connected to an interface of a functional module wherein at least the functional module is removable from the second manifold.

12. The installation according to claim 1, wherein the first production pipeline and the second production pipeline operate at different working pressures, and wherein the installation is configured to route production fluid into the first production pipeline and/or the second production pipeline depending upon the pressure of the production fluid.

13. A subsea manifold for a subsea oil and gas production installation, the manifold comprising:

at least one fluid access point for a subsea well configured to be connected to one or more removable modules and to be fluidly connected to a subsea well to receive production fluid therefrom;

a main flow bore configured to be in fluid communication with a subsea production pipeline; and a flowline connector for a jumper flowline, configured to be fluidly connected to a jumper flowline;

wherein the manifold defines a first flow path between the at least one fluid access point and the main flow bore and a second bypass flow path between the at least one fluid access point and the flowline connector for a jumper flowline, bypassing the main flow bore; and wherein the one or more removable modules is configured to selectively route the production fluid into the first flow path and/or the second flow path of the subsea manifold.

14. A method of controlling production flow from one or more subsea wells, the method comprising:

providing a subsea production system comprising:

at least one subsea well, a first production pipeline in fluid communication with a first subsea manifold and a second production pipeline in fluid communication with a second subsea manifold;

wherein at least one subsea well is connected to the first subsea manifold;

wherein the first subsea manifold and the second subsea manifold are fluidly coupled to one another by a connecting flowline; and wherein the first subsea manifold is provided with a flow control means operable to route the production fluid from the at least one subsea well into the first production pipeline via the first subsea manifold and/or into the second production pipeline via the second first manifold, the connecting flowline and the second subsea manifold.

15. The method according to claim 14, wherein the first production pipeline has a first working pressure and the second production pipeline has a second working pressure, and the method comprises directing production flow from the at least one subsea well into the first and/or the second production pipeline depending on the pressure of the fluid produced from the well.

16. The method according to claim 14, comprising operating valves to select whether the production flow is directed into the first or the second production pipeline.

17. The method according to claim 14, comprising directing fluid into the first production pipeline via the first subsea manifold.

18. The method according to claim 14, comprising directing fluid into the second production pipeline via the first subsea manifold, the connecting flowline, a removable module to which the connecting flowline is coupled connected to the second subsea manifold and the second subsea manifold.

19. A method of installing a distributed manifold system, the method comprising:

installing a first production pipeline and a first subsea manifold in fluid communication with the first subsea pipeline and installing a second subsea pipeline and a second subsea manifold in fluid communication with the second subsea pipeline, wherein the first subsea manifold comprises a fluid access interface and a flowline connector;

installing a connecting flowline between the first subsea manifold and the second subsea manifold, wherein the connecting flowline is connected at a first end to the flowline connector of the first subsea manifold;

fluidly connecting a removable module to the fluid access interface of the first subsea manifold, wherein the removable module is fluidly connected to at least one subsea well, such that production fluid from the at least one subsea well can be selectively routed into the first production pipeline via the removable module and the first subsea manifold or the second production pipeline via the removable module, the first subsea manifold, the connecting flowline and the second subsea manifold.

20. The method according to claim 19, comprising:

installing a flow access hub onto the fluid access point of the first subsea manifold; and installing the removable module to the flow access hub located on the fluid access interface of the first subsea manifold.

* * * * *